US010472137B2

(12) United States Patent
Vachon

(10) Patent No.: US 10,472,137 B2
(45) Date of Patent: Nov. 12, 2019

(54) VENTED SPOUT FOR A LIQUID STORAGE CONTAINER

(71) Applicant: LE GROUPE DSD INC., Thetford Mines (CA)

(72) Inventor: Leandre Vachon, Thetford Mines (CA)

(73) Assignee: LE GROUPE DSD INC., Thetford Mines, Quebec (CA)

( * ) Notice: Subject to any disclaimer, the term of this patent is extended or adjusted under 35 U.S.C. 154(b) by 0 days.

(21) Appl. No.: 16/169,555

(22) Filed: Oct. 24, 2018

(65) Prior Publication Data

US 2019/0144172 A1 May 16, 2019

(30) Foreign Application Priority Data

Nov. 14, 2017 (CA) ..... 2985510

(51) Int. Cl.

| | |
|---|---|
| ***B65D 47/06*** | (2006.01) |
| ***B67D 7/00*** | (2010.01) |
| ***B65D 25/48*** | (2006.01) |
| ***B65D 51/16*** | (2006.01) |
| *B65D 47/14* | (2006.01) |
| *B65D 47/12* | (2006.01) |

(52) U.S. Cl.

CPC ..... *B65D 47/061* (2013.01); *B65D 25/48* (2013.01); *B65D 47/068* (2013.01); *B65D 51/1683* (2013.01); *B67D 7/005* (2013.01); *B65D 47/121* (2013.01); *B65D 47/142* (2013.01)

(58) Field of Classification Search

CPC .. B65D 47/061; B65D 47/068; B65D 47/121; B65D 47/142; B65D 51/1683; B67D 7/005

USPC ..... 222/153, 14, 484, 481.5, 481, 482, 222/566–568, 453, 514; 141/296, 198

See application file for complete search history.

(56) References Cited

U.S. PATENT DOCUMENTS

| | | | | |
|---|---|---|---|---|
| 886,237 | A * | 4/1908 | Murtha | 222/533 |
| 4,478,242 | A | 10/1984 | Bond | |
| 4,564,132 | A | 1/1986 | Lloyd-Davies | |
| 4,746,036 | A | 5/1988 | Messner | |
| D303,634 | S | 9/1989 | Vachon | |
| 4,958,668 | A | 9/1990 | Vachon | |

(Continued)

FOREIGN PATENT DOCUMENTS

| | | |
|---|---|---|
| EP | 00112938 A2 | 7/1984 |
| WO | 2015052507 A1 | 4/2015 |

*Primary Examiner* — Lien M Ngo

(74) *Attorney, Agent, or Firm* — IPAXIO S.E.N.C.

(57) ABSTRACT

The spout includes a first and a second member. The first member includes an elongated and generally tubular first main body having two segregated and parallel internal passageways, one being an air duct and the other being a liquid duct. Both ducts are substantially straight and substantially unobstructed along the entire first main body but the air duct ends with at least one constricted opening through which the air circuit exits the air duct. A valve is juxtaposed to the rear end of the first main body and is made integral therewith. The valve engages a valve seat provided at the rear end of a tubular inner conduit inside the second member and in which a rear section of the first main body is slidingly axially movable. The valve is normally maintained closed by a biasing element. The spout may be provided with a child resistant closure (CRC) device.

20 Claims, 22 Drawing Sheets

(56) References Cited

U.S. PATENT DOCUMENTS

| | | | | |
|---|---|---|---|---|
| 5,107,909 | A * | 4/1992 | Donovan | B67D 7/005 141/198 |
| 5,228,487 | A | 7/1993 | Thiermann et al. | |
| 5,255,713 | A | 10/1993 | Scholle et al. | |
| 5,406,994 | A | 4/1995 | Mitchell et al. | |
| 5,507,328 | A | 4/1996 | Donovan | |
| 5,560,522 | A | 10/1996 | Clark | |
| 5,628,352 | A | 5/1997 | Gracyalny et al. | |
| 5,711,355 | A | 1/1998 | Kowalczyk | |
| 5,961,001 | A | 10/1999 | Davis et al. | |
| 6,155,464 | A | 12/2000 | Vachon | |
| 6,227,419 | B1 | 5/2001 | Raboin | |
| 6,401,752 | B1 | 6/2002 | Blackbourn et al. | |
| 6,435,380 | B1 | 8/2002 | Raboin | |
| 6,722,535 | B1 | 4/2004 | Flach | |
| 6,742,680 | B2 | 6/2004 | Friedman | |
| 6,968,875 | B2 | 11/2005 | Nielsen | |
| 7,013,936 | B2 | 3/2006 | Schliemann et al. | |
| 7,513,395 | B2 | 4/2009 | Labinski et al. | |
| 7,543,723 | B2 | 6/2009 | Wilford et al. | |
| 7,621,304 | B2 | 11/2009 | Nielsen | |
| 8,038,035 | B2 | 10/2011 | Forbis | |
| 8,113,239 | B2 | 2/2012 | Richards et al. | |
| 8,201,595 | B2 | 6/2012 | Trippi, Jr. | |
| 8,403,185 | B2 | 3/2013 | Vachon | |
| 8,561,858 | B2 | 10/2013 | Vachon | |
| 8,567,646 | B1 | 10/2013 | Cray | |
| 8,616,419 | B2 * | 12/2013 | Slack | B65D 1/12 222/533 |
| 8,800,826 | B2 | 8/2014 | Forbis et al. | |
| 9,493,280 | B2 * | 11/2016 | Wilkinson | B65D 47/248 |
| 10,308,405 | B2 * | 6/2019 | Gaikwad | B65D 47/32 |
| 2012/0118431 | A1 | 5/2012 | Dickie | |
| 2014/0097210 | A1 | 4/2014 | Wright | |
| 2015/0053725 | A1 | 2/2015 | Hingorani | |
| 2017/0327281 | A1 * | 11/2017 | Cross | B65D 25/2882 |
| 2018/0037379 | A1 | 2/2018 | Adam et al. | |

* cited by examiner

VENTED SPOUT FOR A LIQUID STORAGE CONTAINER

CROSS-REFERENCE TO RELATED APPLICATION

The present case claims the benefit of Canadian patent application No. 2,985,510 filed on 14 Nov. 2017, which application is hereby incorporated by reference in its entirety.

TECHNICAL FIELD

The technical field relates generally to vented spouts for liquid-storage containers.

BACKGROUND

Many different kinds of spouts have been proposed over the years for use during a gravity transfer of liquids from a container into a receptacle, such receptacle being for instance another container or a tank, to name just a few examples. Some of these spouts include an air vent to admit air inside the container through the spouts when the liquid flows, and also a shutoff valve to control the liquid flow during the transfer. Examples can be found, for instance, in U.S. Pat. Nos. 8,403,185 and 8,561,858.

While most of the prior arrangements have been generally useful and convenient on different aspects, there are still some limitations and challenges remaining in this technical area for which further improvements would be highly desirable.

SUMMARY

In one aspect, there is provided a vented pouring spout for a liquid-storage container, the spout including: a first member including: an elongated and generally tubular first main body having a front section and a rear section, the first main body having two segregated and parallel internal passageways, one being an air duct through which an air circuit passes when air enters the container and one being a liquid duct through which a liquid circuit passes when the liquid flows out of the container, the air duct being generally positioned along a top side of the first main body and being smaller in cross section than that of the liquid duct, the liquid duct being substantially straight and substantially unobstructed along the entire first main body, the air duct being substantially straight and substantially unobstructed along the entire first main body up to at least one constricted opening, generally positioned at a rear end of the first main body, from which the air circuit exits the air duct; a valve that is juxtaposed to the rear end of the first main body, the valve having a rear section and a front tapered section extending from the rear section, the rear section of the valve supporting a valve gasket and the front tapered section being made integral with the rear section of the first main body, the front tapered section being adjacent to an inlet of the liquid duct and to the at least one constricted opening; and a protrusion projecting underneath the front section of the first main body; a second member that is shorter in length than the first member, the second member including an elongated second main body, the second main body having a straight tubular inner conduit inside which the rear section of the first main body is slidingly axially movable, the inner conduit having a rear end defining a valve seat that is engaged by the valve gasket when the valve is in a closed position to block the air circuit and the liquid circuit, the valve gasket being out of engagement with the valve seat and being positioned rearward of the valve seat when the valve is in a fully-opened position; an inner gasket provided between the first member and the second member to seal in an air-tight manner an intervening peripheral space between the rear section of the first main body and the inner conduit of the second main body; and a biasing element positioned between the first member and the second member to urge the valve in the closed position.

In another aspect, there is provided a vented spout as shown, described and/or suggested herein.

Further details on these aspects as well as other aspects of the proposed concept will be apparent from the following detailed description and the appended figures.

DETAILED DESCRIPTION

Figure 1:
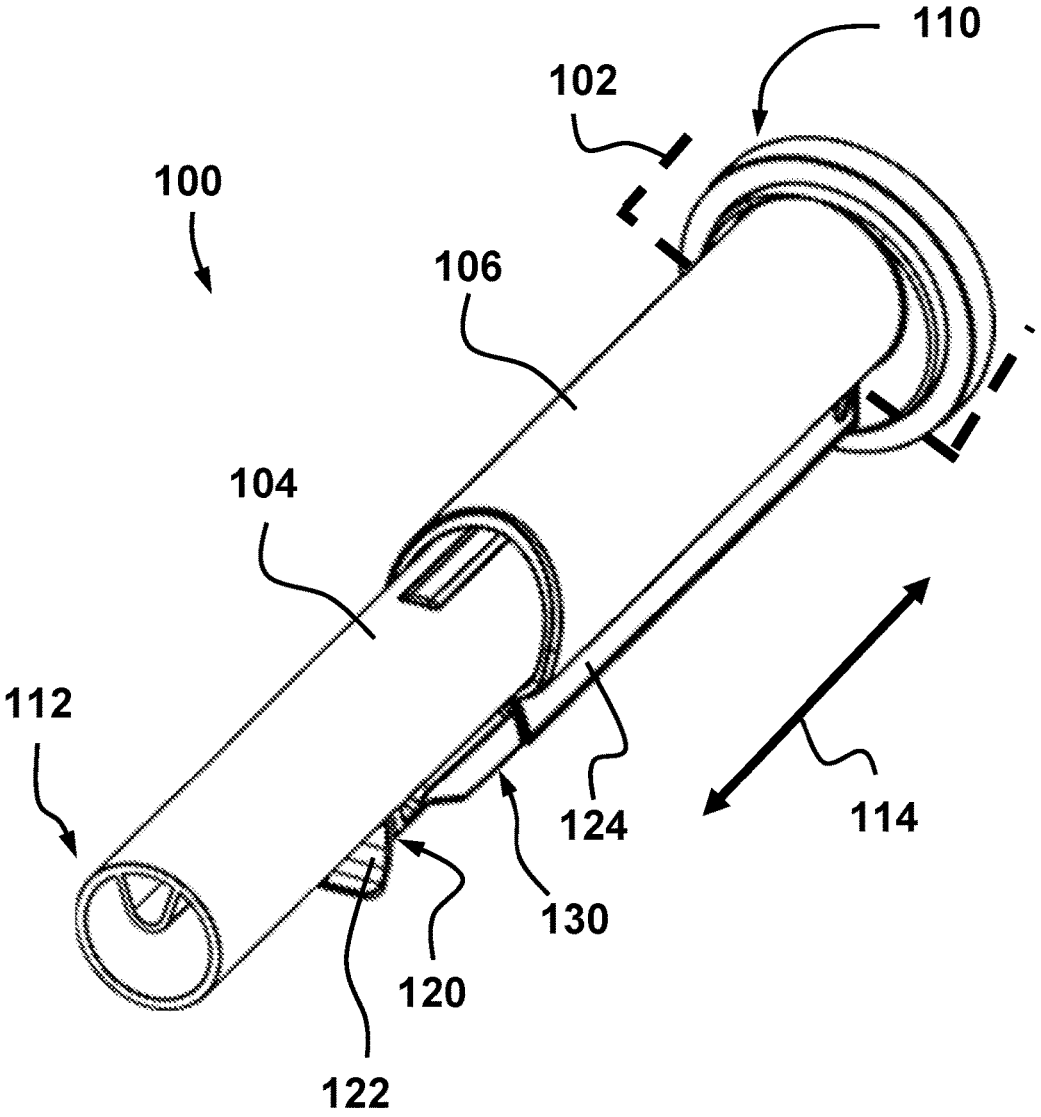
FIG. 1 is an isometric view illustrating an example of a spout incorporating the proposed concept.

FIG. 1 is an isometric view illustrating an example of a spout 100 incorporating the proposed concept. The spout 100 is designed to be mounted onto a liquid-storage container. A generic container is schematically depicted in FIG. 1 at 102. This container 102 can be, for instance, a portable container or canister designed for transporting and storing liquid fuel products, such as gasoline or diesel. The spout 100 as illustrated is well adapted for use with hazardous volatile liquids such as fuel products. Nevertheless, the spout 100 can work equally well with a very wide range of liquids that are not fuel products.

The spout 100 includes a first member 104 and a second member 106. The first member 104 is longer than the second member 106 and it has a rear section that in a sliding engagement inside the second member 106.

The spout 100 extends mostly in a straight line, between a base 110 and a tip 112, that is parallel to a longitudinal axis 114. The tip 112 corresponds to the front end of the first member 104, thus the end that is away from the base 110. The base 110 is the part of the spout 100 that can be removably attached to the container 102. The base 110 of the illustrated example is circular in shape and is designed to fit over the front edge of the neck of the container 102. The base 110 is slightly larger in diameter than that of the neck. The spout 100 can be secured to the neck, thus to the container 102, using a corresponding collar (not shown) having internal threads matching the external threads on the neck. The collar includes a central opening through which the spout 100 can fit up to the base 110. The collar can then be tightened on the neck of the container 102 until the spout 100 is solidly secured. The spout 100 will extend outside the container 102 and is ready to be used for pouring.

The spout 100 includes a built-in shutoff valve generally positioned at the base 110 and that is normally closed. Hence, the valve remains closed when untouched.

As can be seen, the first member 104 includes a first bottom protrusion 120 projecting underneath the outer wall surface thereof. This first bottom protrusion 120 is only partially visible in FIG. 1 but can be seen entirely in subsequent figures. It is positioned approximately halfway between the tip 112 and the front end of the second member 106 in the illustrated example. The illustrated spout 100 is a model having about 7 inches (17.8 cm) in length. Other configurations and arrangements are possible.

The illustrated first bottom protrusion 120 includes an enlarged front portion, hereafter called the trigger 122, which has a surface at the front that is generally perpendicular to the longitudinal axis 114. It is also slightly curved at the bottom in the example and it is positioned about 1.75 inch (4.5 cm) from the tip 112 in the example. The trigger 122 is where an actuation force can be applied, for instance using a finger, to open the valve inside the spout 100. Other configurations and arrangements are also possible. The valve will open in the illustrated example when the first member 104 axially slides toward the rear with reference to the second member 106.

The second member 106 of the illustrated example includes an elongated external conduit 124 that is longitudinally disposed along the undersurface thereof. This external conduit 124, among other things, holds a biasing element to urge the valve into its normally-closed position. It also serves in the example as an abutment for a child resistant closure (CRC) device 130. This CRC device 130 is provided for preventing young children, particularly children up to six years old, from opening the valve inside the spout 100. The CRC device 130 acts as a fail-safe childproof security system that keeps the spout 100 locked unless a release operation is performed. This CRC device 130 can also automatically resets itself back to the locked position once the valve is minimally opened, for instance of about 10%, just enough for some liquid to flow. Further details on the CRC device 130 will be given later in the present detailed description. Variants are possible. The CRC device 130 can be omitted in some implementations.

Figure 2:
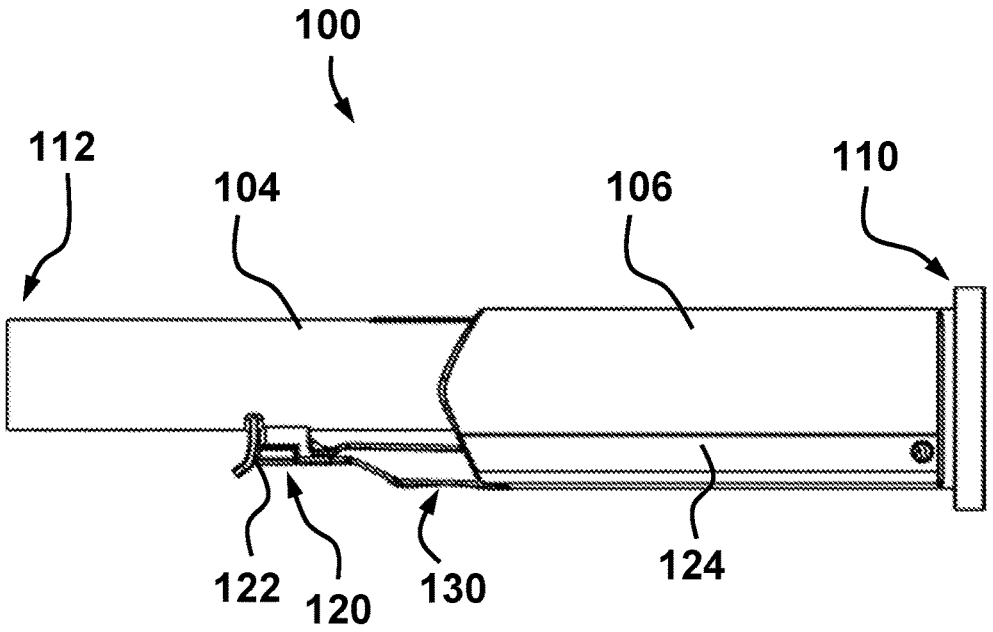
FIG. 2 is a side view of the spout in FIG. 1.
Figure 3:
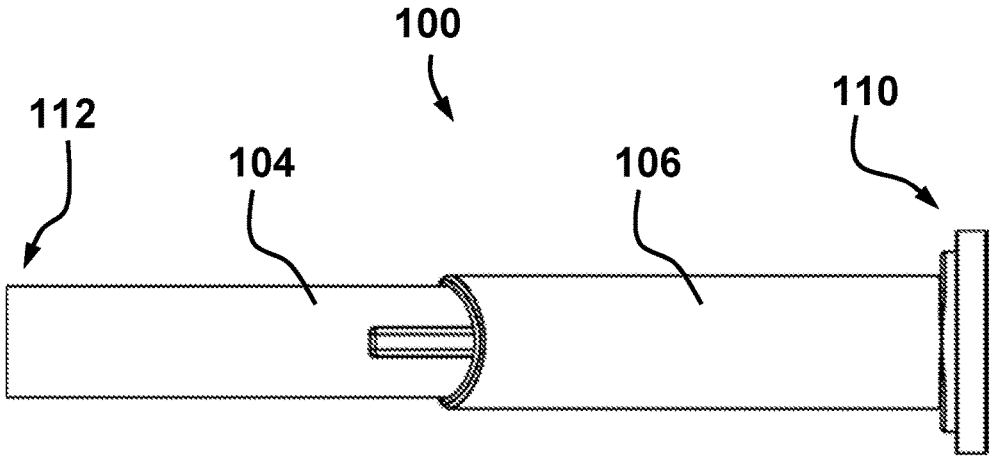
FIG. 3 is a top view of the spout in FIG. 1.
Figure 4:
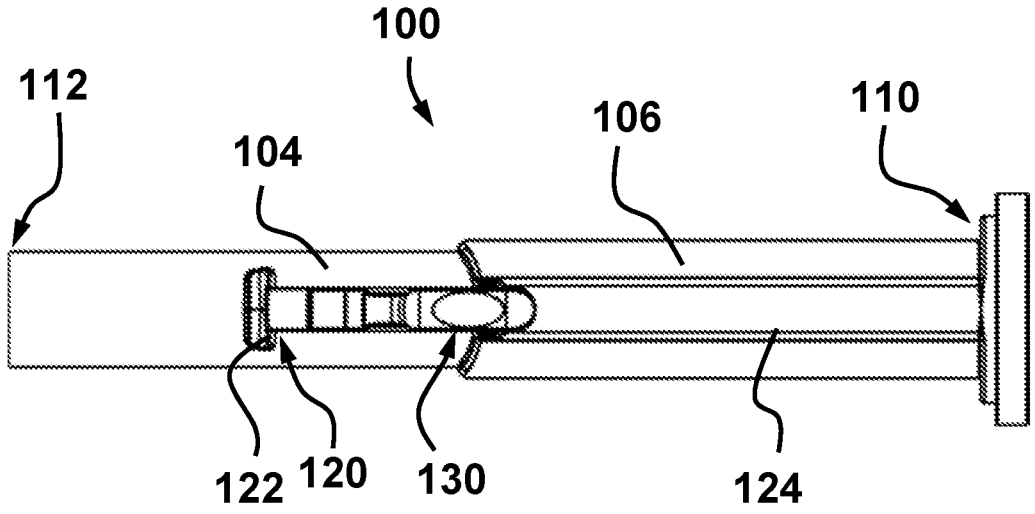
FIG. 4 is a bottom view of the spout in FIG. 1.

FIGS. 2, 3 and 4 are, respectively, a side view, a top view and a bottom view of the spout 100 in FIG. 1. They show the various parts from different angles.

Figure 5:
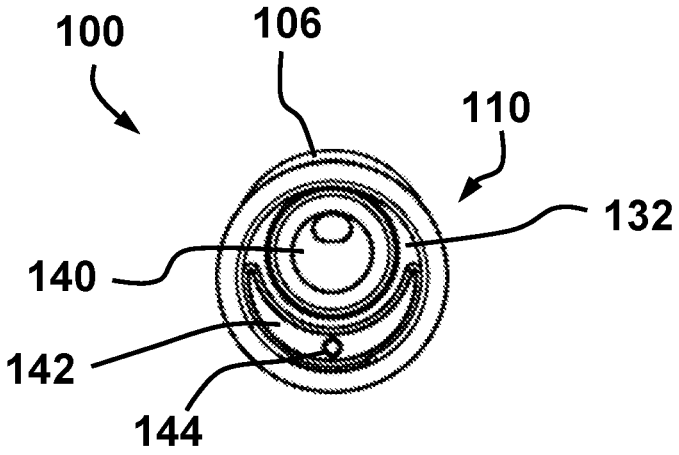
FIG. 5 is a rear view of the spout in FIG. 1.

FIG. 5 is a rear view of the spout 100 in FIG. 1. It shows that the spout 100 has circular opening 132 on the rear side of the base 110. FIG. 5 also shows the rear side of the valve 140 in the spout 100. The geometric center of this valve 140 is offset with reference to the geometric center of the opening 132 in the illustrated example. Variants are possible. Still, an arc-shaped recess 142 is present below the valve 140 in the illustrated example. This recess 142 is provided, among other things, to minimize the amount of plastic resin material for producing each spout 100. A small peg 144 projects from the bottom surface of the recess 142 in the example. This peg 144 is the location where the plastic resin material was injected in the mold during manufacturing. Other materials, configurations and arrangements are possible.

Figure 6A:
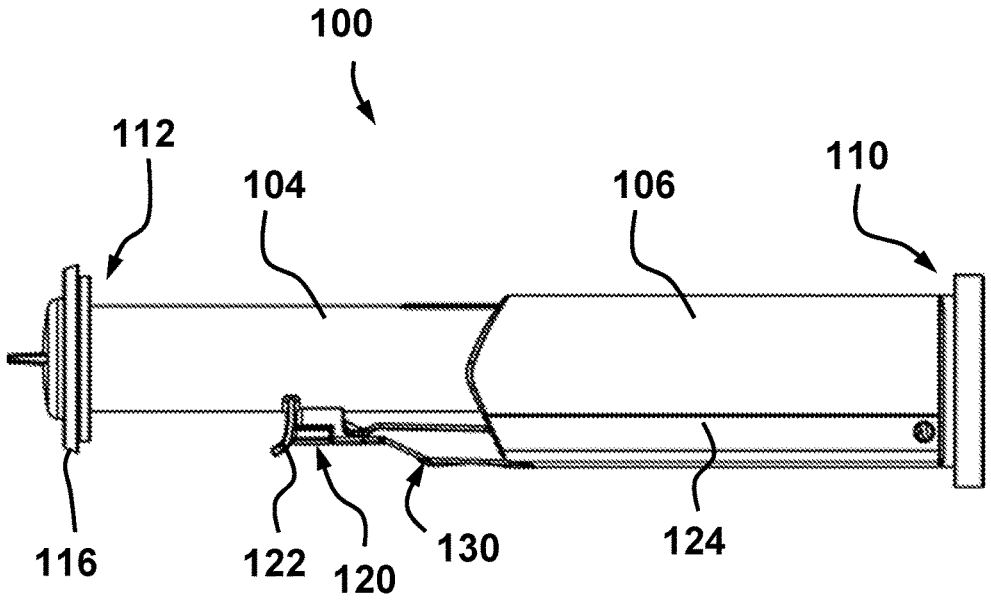
FIG. 6A corresponds to the view in FIG. 2 when a cap is inserted over the tip.

The spout 100 of FIG. 1 can be used with a complementary protective cap 116. This removable cap 116 can be set over the tip 112, as shown in FIG. 6A. FIG. 6A corresponds to the view in FIG. 2 but with the cap 116 on the tip 112. This cap 116 is press-fitted onto the tip 112 and is kept in that position because of an interfering engagement between the parts. This cap 116 is useful for preventing undesirable matters, such as water, dirt, etc. from entering the spout 100 through the tip 112 during storage and transportation, for instance when the spout 100 extends outside of the container 102. Other configurations and arrangements are possible. The cap 116 can be omitted in some implementations.

Figure 6B:
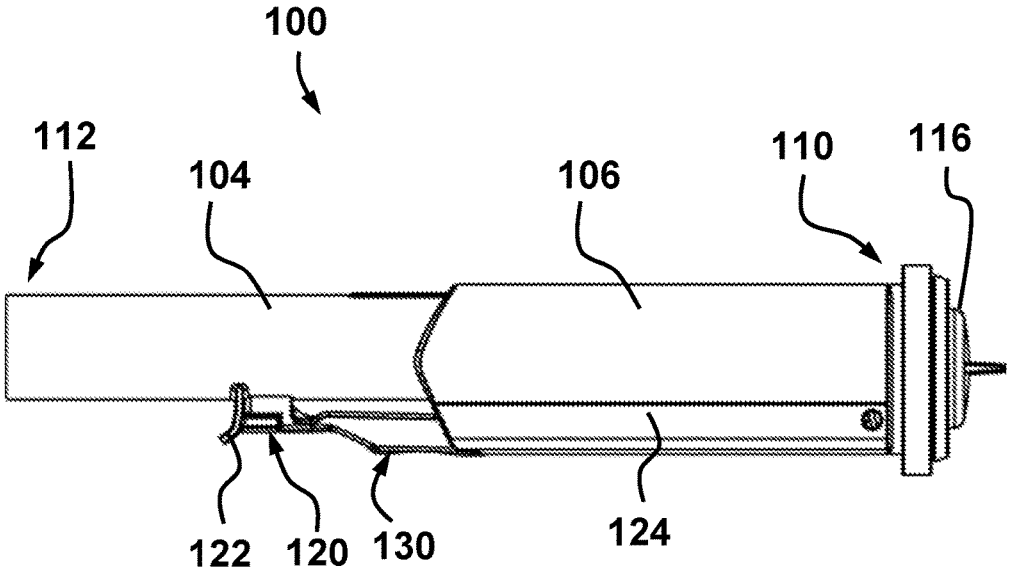
FIG. 6B corresponds to the view in FIG. 2 when a cap is inserted over the opening of the base.

Furthermore, if desired, the spout 100 of the illustrated example can be positioned almost entirely inside the container 102 when not needed for pouring liquid, for instance during storage or transportation of the container 102. To do so, the spout 100 can be inserted through the neck of the container 102, with the tip 112 first, until the base 110 abuts on the front edge of the neck. The collar can then be tightened on the neck of the container 102 to secure the spout 100 and seal the container 102. Putting the spout 100 inside the container 102 could be desirable for minimizing space, among other things. The cap 116 of the illustrated example can then be install over the opening 132 of the base 110 to double close the spout 100, as shown in FIG. 6B. FIG. 6B corresponds to the view in FIG. 2 but with the cap 116 on the opening 132 of the base 110. The cap 116 prevents undesirable matters, such as water, dirt, etc. from soiling the opening 132. The cap 116 also protects the valve 140. Other configurations and arrangements are possible. As aforesaid, the cap 116 can be omitted in some implementations.

Figure 7:
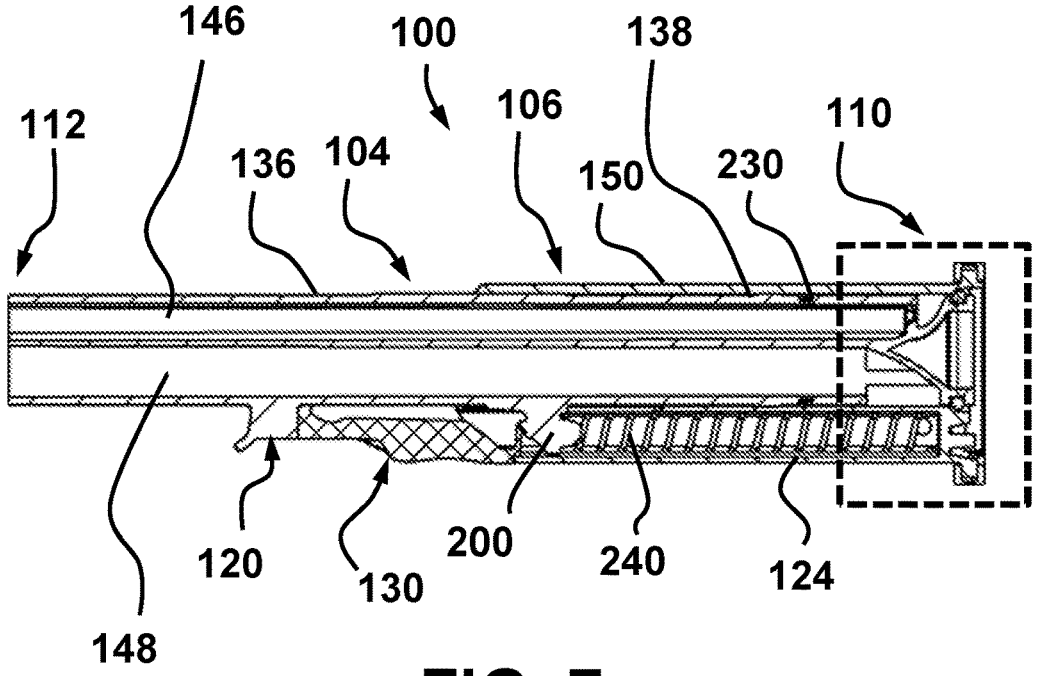
FIG. 7 is a longitudinal cross section view of the spout in FIG. 1.

FIG. 7 is a longitudinal cross section view of the spout 100 in FIG. 1 to show the parts therein. The valve 140 is in its normally closed position in FIG. 7 and the spout 100 is thus closed.

The first member 104 includes an elongated and generally tubular first main body 134 that extends over almost the entire length of the spout 100. Variants are possible. For instance, although the first main body 134 has a generally circular cross section, other shapes and configurations are possible in some implementations. The word "tubular" is used in a generic way and does not imply in itself that the first main body 134 must necessarily always be circular in shape on the outside in every possible implementation. Accordingly, noncircular shapes are possible. This remark also applies to other tubular parts of the spout 100 as well.

The first main body 134 has a front section 136 and a rear section 138. The front section 136 is generally positioned outside the second member 106 while the rear section 138 is generally positioned inside the second member 106 in the normally closed position, as shown in FIG. 7. The second member 106 includes an elongated main body 150 having a straight tubular inner conduit 152 (FIG. 33) inside which the rear section 138 of the first main body 134 is disposed. They are both in axial sliding engagement with one another along the longitudinal axis 114. The second member 106 also includes an enlarged end portion that forms the base 110. Other configurations and arrangements are possible.

The first main body 134 includes two segregated internal passageways that are entirely enclosed therein. One is an air duct 146 and the other is a liquid duct 148. They are both separated from one another along the entire length of the first member 104 up to the valve 140 at the rear end. The air duct 146 is generally positioned along a top side of the first main body 134 and is smaller in cross section than that of the liquid duct 148. The cross-section area of the air duct 146 is about 30 times smaller than that of the liquid duct 148 in the example. Variants are possible as well.

Figure 8:
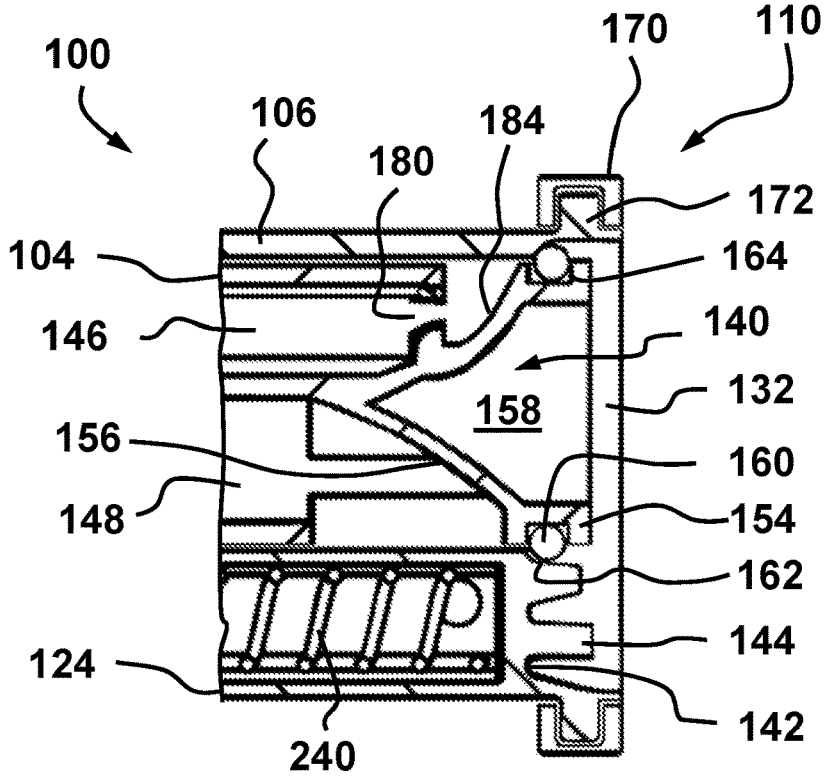
FIG. 8 is an enlarged view of the base of the spout in FIG. 7.

FIG. 8 is an enlarged view of the base 110 of the spout 100 in FIG. 7. The corresponding enlarged area is identified in FIG. 7 using the stippled line. FIG. 8 shows various details concerning the valve 140 of the illustrated example. The valve 140 simultaneously controls both the flow of liquid coming out of the container 102 and the flow of air coming therein. This air is required for the liquid to flow out of the container 102 quickly and continuously.

Portable containers, such as those commonly available for transporting and storing for fuel products, generally include an auxiliary vent opening. This auxiliary vent opening is relatively small in size and is normally closed by a corresponding treaded cap or the like. It is provided for releasing built-in pressure inside the containers or to admit air when pouring liquids using non-vented spouts. Such auxiliary vent opening should remain completely closed when pouring liquid using the vented spout 100. Nevertheless, the spout 100 can still be used even if the auxiliary vent opening is partially or fully opened but the user will then miss a desirable feature thereof. For the sake of simplicity, the rest of the present detailed description will assume that air can only enter the container 102 through the vented spout 100 during pouring.

The valve 140 is an integral part of the first member 104 in the illustrated example. It is juxtaposed to the rear end of the first member 104 and is immediately upstream of the entrance of the liquid duct 148. The valve 140 has a main body. It also includes an enlarged rear section 154 and a front tapered section 156 extending from the rear section 154. The front tapered section 156 has a somewhat conical shape that facilitates the flow of liquid towards the interior of the liquid duct 148 when the valve 140 is opened. Nevertheless, other configurations and arrangements are possible.

The rear side of the valve 140 includes a rear-facing open cavity 158 devoid of passageways to the opposite side thereof. This cavity 158 is only provided to minimize the amount of plastic resin material during manufacturing. Nevertheless, the rear side of the valve 140 can be configured differently and the cavity 158 can even be entirely omitted in some implementations.

Figure 9:
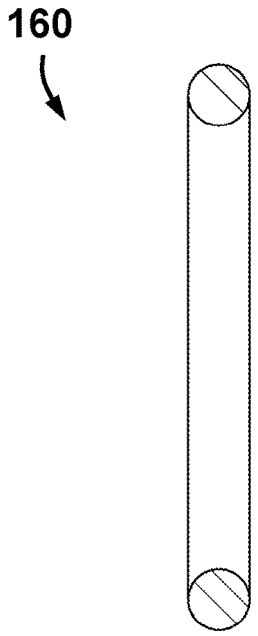
FIG. 9 is a longitudinal cross section view of the valve gasket in FIG. 8.

When the spout 100 of the illustrated example is closed, as shown in FIGS. 7 and 8, a valve gasket 160 located around the rear section 154 of the valve 140 engages a valve seat 162 located on the second member 106 at the base 110. This valve gasket 160 is generally positioned in a corresponding mounting groove 164 at the outer periphery of the rear section 154 of the valve 140. It is made of a resilient elastomeric material and can be an O-ring, as shown. FIG. 9 is a longitudinal cross section view of the valve gasket 160 in FIG. 8. Other configurations and arrangements are possible as well.

FIG. 8 further shows that in the illustrated example, the enlarged end portion of the second member 106 that forms the base 110 includes a removable outer gasket 170 mounted over an outer peripheral flange 172 radially projecting around the base 110. This flange 172 is an integral part of this second member 106. The outer gasket 170 is made of a resilient elastomeric material. It is useful, among other things, for sealing both sides. Other configurations and arrangements are possible.

Figure 10:
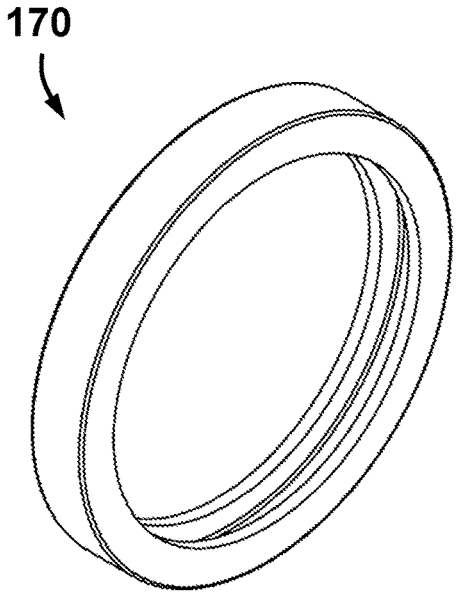
FIG. 10 is an isometric view of the outer gasket in FIG. 8.
Figure 11:
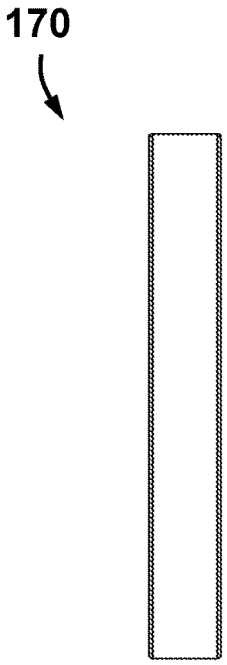
FIG. 11 is a lateral view of the outer gasket in FIG. 8.
Figure 12:
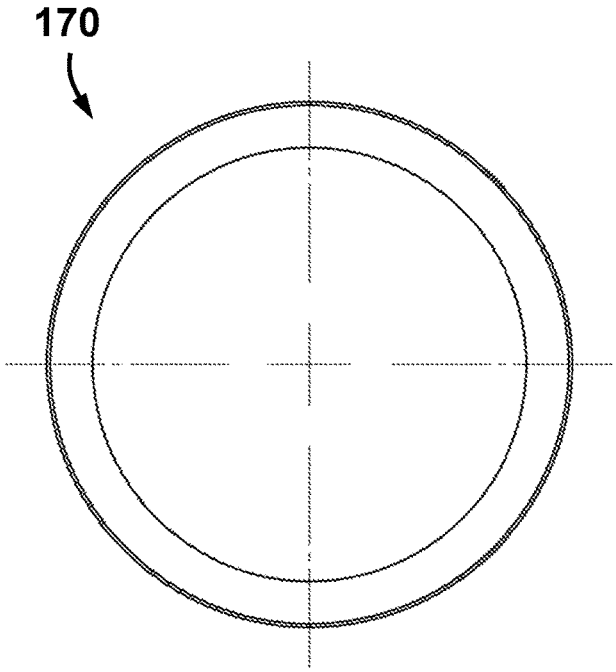
FIG. 12 is a front side view of the outer gasket in FIG. 8.
Figure 13:
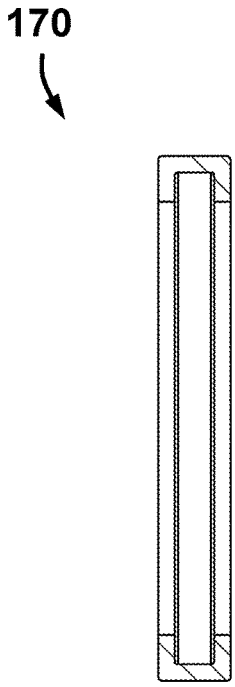
FIG. 13 is a longitudinal cross section view of the outer gasket in FIG. 8.

FIGS. 10 to 12 are, respectively, an isometric view, a lateral view and a front side view of the outer gasket 170 in FIG. 8. FIG. 13 is a longitudinal cross section view of this outer gasket 170. As can be seen, the body of the outer gasket 170 has a substantially U-shaped cross section, with the opened side facing radially inwards. Other configurations and arrangements are possible. For instance, the shape of the corresponding parts can be different from what is shown and described. The outer gasket 170 can also be replaced by another element, such as a coextruded part, or by something else. Still, it can be omitted entirely in some implementations, for instance when the sealing function is provided by one or more elements of the container 102 itself, or by one or more external parts. Other variants are possible as well.

Furthermore, FIGS. 7 and 8 show that the air duct 146 is substantially straight and uniform in dimensions from the tip 112 of the spout 100 up to a constricted opening 180. The internal air circuit extending from the tip 112 to the valve 140 must go through this constricted opening 180. The constricted opening 180 has a significantly smaller cross section area than that of the air duct 146 where the opening 180 is the narrowest. The minimum cross section within the constricted opening 180 is preferably about 65% smaller than that of the air duct 146 upstream the constricted opening 180. Nevertheless, other proportions are possible as well. For instance, depending on the implementation, it can be from 40% to 70% smaller, namely from 40% to 45% smaller, or from 45% to 50% smaller, or from 50% to 55% smaller, or from 60% to 65% smaller, or from 65% to 70% smaller. Other values could be used as well in some specific implementations. In all instances, the constricted opening 180 is configured, sized and shaped to accelerate the air velocity at the end of the air duct 146. Air flows through the constricted opening 180 when the liquid is poured, thus when the valve 140 is opened, and some liquid flows out of the container 102. The air path across the constricted opening 180 is substantially parallel to the longitudinal axis 114 (FIG. 1) in the illustrated example. It is thus in alignment with the opening at the inlet of the air duct 146. The restriction is reach within the constricted opening 180 after a depth of about 1/16 in. (1.6 mm) and the opening continues for about 3/16 in (4.8 mm) in the example. Other configurations and arrangements are possible. For instance, although the illustrated example includes a single constricted opening 180 having a somewhat circular cross section, using two or even more openings and other shapes could be possible in some specific implementations. Other variants are possible as well.

When a liquid must be poured from the container 102 and this container is, for instance a portable container, the container 102 will tilted by a user up to a point where the liquid contacts the rear face of the spout 100 if the valve 140 is still closed. The user can also open the valve 140 beforehand so that the liquid reaches the valve 140 while it is already opened. The liquid will then start flowing out of the spout 100 passing through an internal liquid circuit extending from the valve 140 to the tip 112 of the spout 100. However, many users will generally prefer tilting the container 102 first and opening the valve 140 afterwards, particularly if the liquid level inside the container 102 is high. Among other things, the tip 112 of the spout 100 must often be positioned at a specific location to prevent spillage, for instance be in the immediate proximity or be inside an opening of a receptacle in which the liquid is transferred. An example of such receptacle includes a reservoir or tank located on a machine or on a vehicle. The receptacle can also be another container. Many other situations and contexts exist.

When liquid is present on the rear side of the spout 100 while the valve 140 is still closed, the user must eventually open the valve 140, either partially or fully, for the liquid to flow. Liquid will start flowing around the valve 140, between the valve gasket 160 and the valve seat 162 when the valve 140 is moved rearwards over a sufficient distance relative to the valve seat 162. The liquid will then enter the liquid duct 148 but will not enter the air duct 146 because, among other things, the air will come out of the constricted opening 180 at an increased velocity.

It should be noted that the valve seat 162 can be designed to prevent the valve 140 from opening below a certain minimum distance, for instance 0.1 inch (2.5 mm). This will prevent some liquid to enter the liquid duct 148 if the tip 112 simply hits an object, such as when the container 102 is tilted and the user is now positioning the tip 112 prior to the liquid transfer. Variants are possible.

The front tapered surface 156 of the valve 140 in the illustrated example includes a slanted and/or curved surface 184 generally positioned at the top part, immediately in front of the outlet of the constricted opening 180. This surface 184 differs from the other parts of the front tapered surface 156 in that it is provided specifically for guiding the air and facilitating the flow of air during pouring when the container 102 is tilted. The other parts are rather designed to funnel the liquid at the inlet of the liquid circuit when the liquid enters the liquid duct 148 during pouring. Furthermore, it was found that having a very smooth finish on the surface 184 can improve the air flow at the end of the air circuit during pouring and, as a result, improves the liquid flow. Smaller bubbles will form in the liquid when the surface 184 has a smoother finish compared to a regular standard finish. When the first member 104 is made of plastic, the surface in the mold forming the surface 184 can be specifically machined so as to have a surface finish with an extremely high (mirror-like) smoothness, such as A-1 (grade #3 diamond buff) or A-2 (grade #6 diamond buff) on the SPI (Society of the Plastic Industry) finish guide. This enhanced finish will only be provided for the surface 184 to keep the costs down and it is not a finish routinely used in such context. Nevertheless, other configurations and arrangements are possible as well. It can also be omitted in some implementations.

In use, the position of the constricted opening 180, because it is part of the first member 104, will always follow the position of the valve 140. Hence, when the valve 140 is fully opened, the constricted opening 180 of the illustrated example will be positioned beyond the rear edge of the opening 132 of the base 110.

Figure 14:
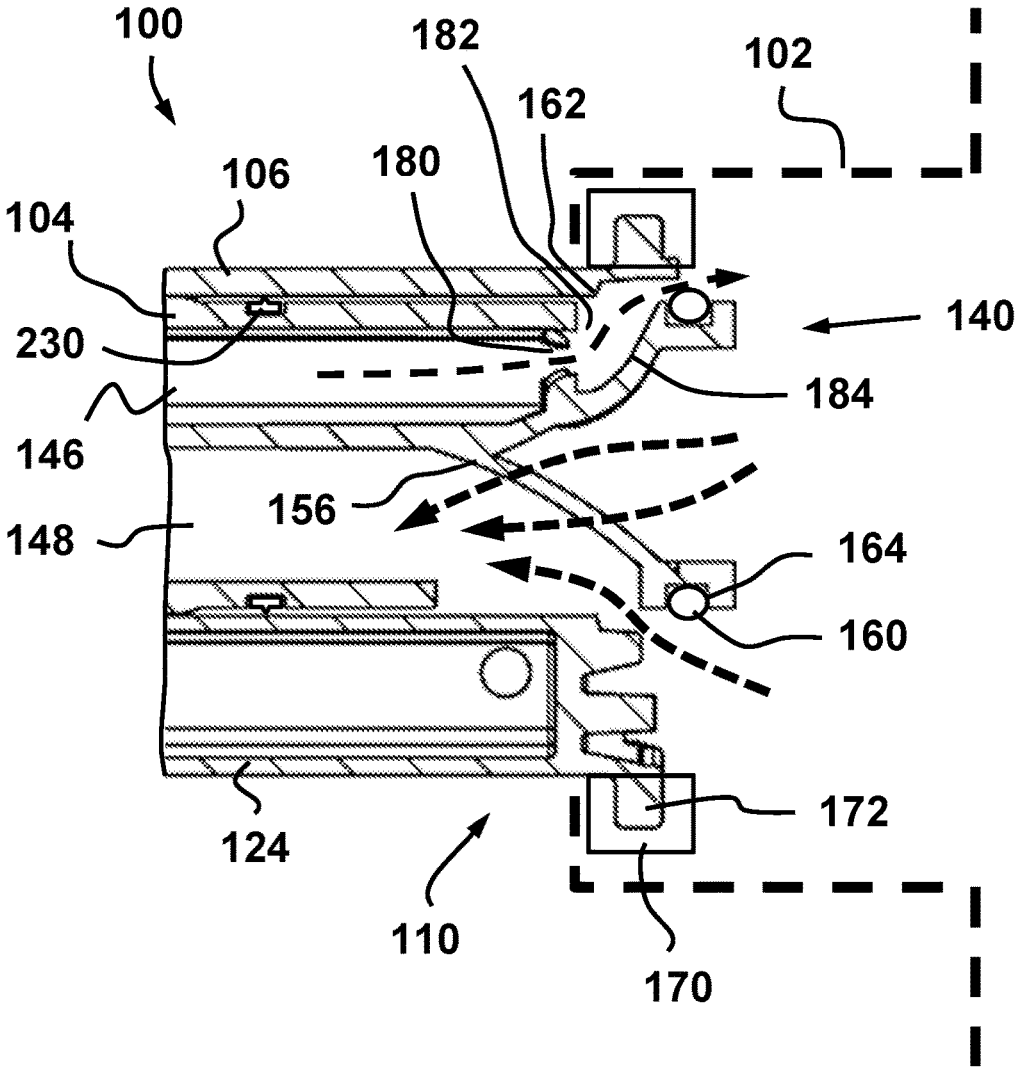
FIG. 14 corresponds to the view of FIG. 8 when the valve is partially opened.

FIG. 14 corresponds to the view of FIG. 8 when the valve 140 is partially opened. The stippled line depicts an example of the path of the air coming out of the air duct 146 to enter the container 102 at this instant. The air circuit passes through the air duct 146 and then through the constricted opening 180 where air is accelerated. It exits the constricted opening 180 to enter in a plenum 182 defined substantially by the walls at the rear end of the air duct 146, the surface 184 and a corresponding part of the second member 106. The air passes at the top between the inner wall of the base 110 and the valve gasket 160, and also on the sides. Keeping the liquid out of the air duct 146 results in a very fast response time when opening the valve 140 and maintains the flow constant.

It should be noted that the exact configuration and arrangement of the parts can be different in some implementations from what is shown in the figures.

Figure 15:
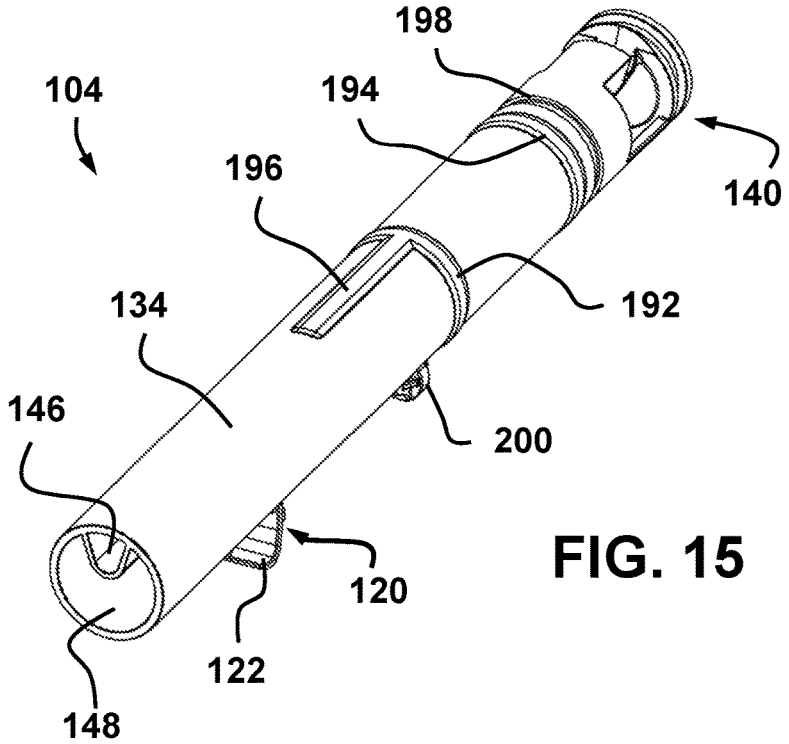
FIG. 15 is an isometric view illustrating the first member in FIG. 1.
Figure 16:
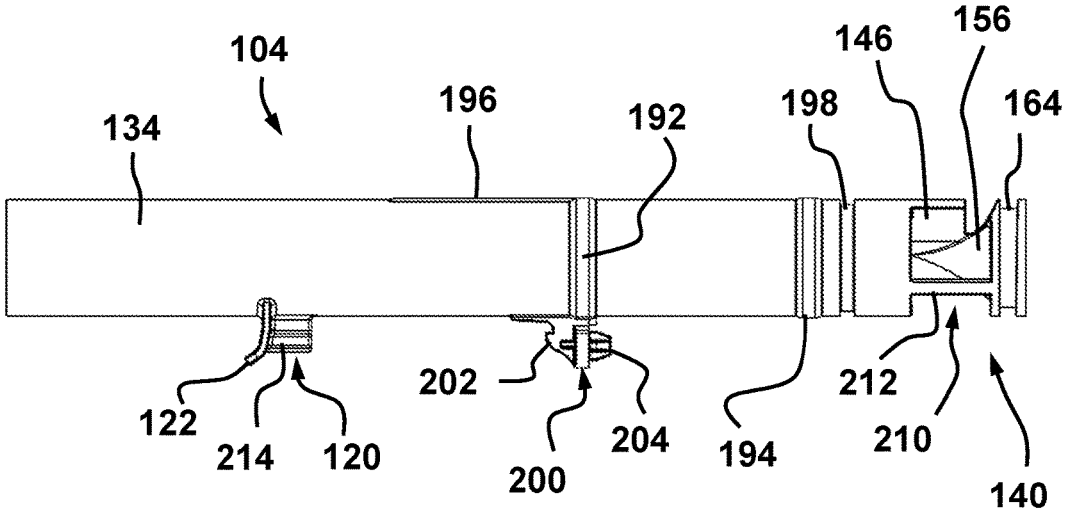
FIG. 16 is a side view of the first member in FIG. 1.
Figure 17:
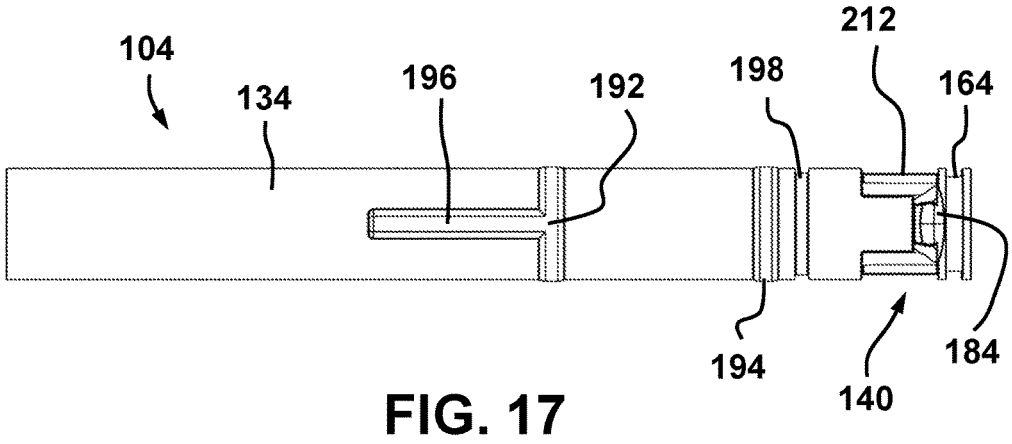
FIG. 17 is a top view of the first member in FIG. 1.
Figure 18:
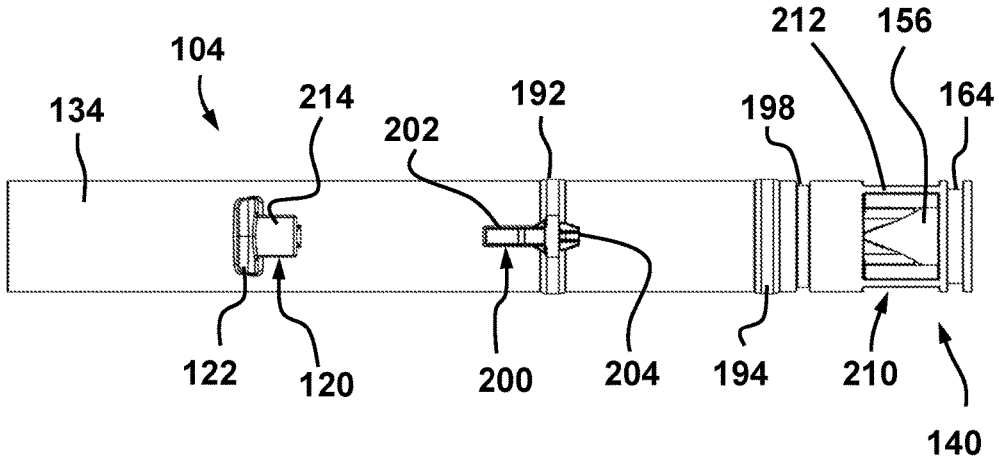
FIG. 18 is a bottom view of the first member in FIG. 1.

FIG. 15 is an isometric view illustrating the first member 104 in FIG. 1. FIGS. 16, 17 and 18 are, respectively, a side view, a top view and a bottom view thereof. The parts of the first member 104 are all made integral with one another in the illustrated example, for instance using an injection molding process of a plastic resin material. Other materials and manufacturing processes are possible as well. Molding all parts of the first member 104 in a monolithic unitary piece, as well as other parts such as the second member 106 and the CRC device 130, can simplify manufacturing and reduce labor costs, among other things. The number of molds is also minimized. Nevertheless, in some implementations, the first member 104 could be an assembly of two or more parts. Other variants are possible.

As can be seen in FIGS. 15 to 18, the first main body 134 of the illustrated example includes a number of guiding elements projecting slightly above its outer wall surface.

They are configured and disposed to engage the smooth inner wall surface of the inner conduit 152. The total surface area of the first member 104 that will be in direct contact with the second member 106 is then minimized and the sliding movement will be facilitated. Other configurations and arrangements are possible.

There are two spaced-apart annular guiding elements 192, 194 in the illustrated example. They will remain inside the second member 106 regardless the position of the valve 140 is opened. The annular guiding element 194 is positioned closer to the rear end than the annular guiding element 192. They both have a relatively large and smooth outer surface, as well as somewhat rounded lateral edges to facilitate the relative axial sliding motion between the first member 104 and the second member 106. The illustrated first member 104 further includes a longitudinally-disposed guiding element 196 extending along a given length towards the front of the spout 100 along the top of the first main body 134. The rear end of this longitudinally-disposed guiding element 196 merges with the annular guiding element 192 in the illustrated example. The longitudinally-disposed guiding element 196 has a relatively large and smooth outer surface that is slightly curved in cross section to match the curvature of the inner wall surface inside the second member 106. The front end of the longitudinally-disposed guiding element 196 can extend beyond the front edge of the second member 106, as can be seen for instance in FIG. 1. The longitudinally-disposed guiding element 196 is provided to facilitate the axial sliding motion. It should be noted that other configurations and arrangements are possible. It is also possible to omit one or more, or even all, of the guiding elements in some implementations. Other variants are possible as well.

The illustrated first member 104 further includes an annular groove 198 located between the annular guiding element 194 and the valve 140. This groove 198 is made within the outer wall surface of the first main body 134 to receive a corresponding inner gasket. This inner gasket is provided to seal the intervening peripheral space between the first member 104 and the second member 106 in an air-tight manner. Further details on this arrangement will be given later in the present detailed description. Other configurations and arrangements are possible as well.

Still, the illustrated first member 104 further includes a second bottom protrusion 200 projecting from the outer wall surface underneath the first main body 134. The second bottom protrusion 200 is only partially visible in FIG. 15 but can be seen in greater details in subsequent figures. It is positioned approximately halfway along the first member 104 of the illustrated example. However, its position can be different in other implementations. The second bottom protrusion 200 includes a base portion 202 and has a mounting member 204 projecting rearwards from the base portion 202. This mounting member 204 is provided as an attachment point for the biasing element of the illustrated spout 100. Other configurations and arrangements are possible.

As best shown in FIG. 16, a relatively large opening 210 surrounds the valve 140. This opening 210 surrounds the entire periphery of the front tapered section 156 of the valve 140 in the illustrated first member 104. The opening 210 generally corresponds to the inlet of the liquid circuit and the outlet of the air circuit. It is only partially obstructed by the walls surrounding the air duct 146 at the top side and by the spaced-apart longitudinally-disposed and elongated support members 212 attaching the outer periphery of the valve 140 to the rest of the first member 104. These support members 212 are, however, relatively narrow in width and in thickness. The front tapered section 156 can also be seen. The longitudinal position of the front edge of the opening 210 corresponds approximatively to that of the front tapered section 156. Other configurations and arrangements are possible. For instance, the support members 212 can be omitted in some implementations.

Still, FIG. 16 shows that the air duct 146 extends beyond the rear end of the liquid duct 148 in the illustrated example. This positions the constricted opening 180 closer to the surface 184 (FIG. 17). The front end of the front tapered section 156 can be made integral with the underside of the sidewall surrounding the extension. Other configurations and arrangements are possible.

As can be appreciated, the restrictions to the flow of liquid are also very low in the illustrated example, thereby maximizing the liquid output when the valve 140 is fully opened.

FIG. 16 shows that the first bottom protrusion 120 of the illustrated example includes a rear supporting element 214. The rear supporting element 214 generally extends longitudinally behind the trigger 122. It reinforces the connexion of the trigger 122 but it also serves as an attachment point for the front end of the CRC device 130. Other configurations and arrangements are possible as well.

FIG. 17 shows the surface 184, among other things. It also shows that the opening 210 is shorter in length at the top. Other configurations and arrangements are possible as well.

Figure 19:
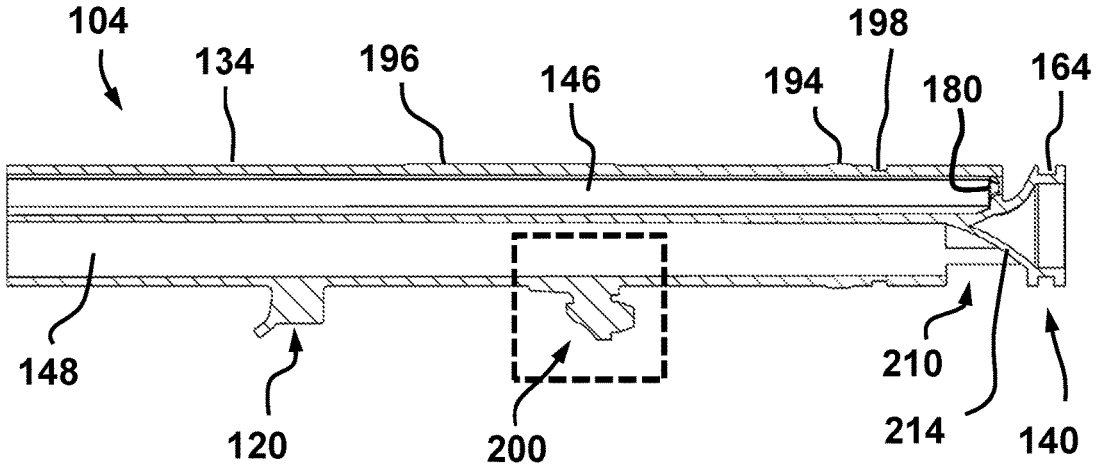
FIG. 19 is a longitudinal cross section view of the first member in FIG. 1.

FIG. 19 is a longitudinal cross section view of the first member 104 in FIG. 1.

Figure 20:
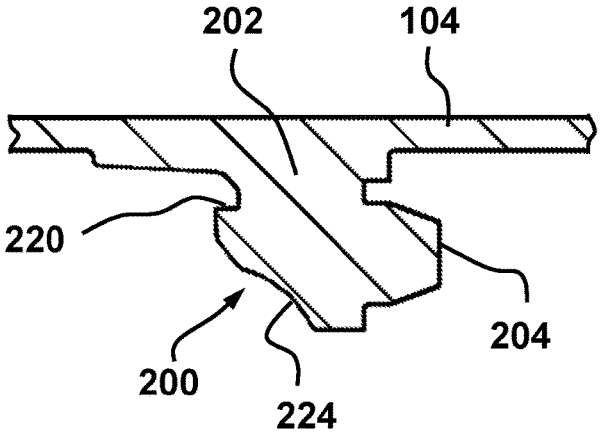
FIG. 20 is an enlarged view of the second bottom protrusion shown in FIG. 19.

FIG. 20 is an enlarged view of the second bottom protrusion 200 shown in FIG. 19. The stippled line in FIG. 19 outlines the corresponding enlarged area. As can be seen, the base portion 202 of the second bottom protrusion 200 in the illustrated example includes a front notch 220 defining a substantially horizontal surface. This front notch 220 is provided to support a corresponding latching element of the CRC device 130 for holding it in its unlocked position. Other configurations and arrangements are possible as well.

Figure 21:
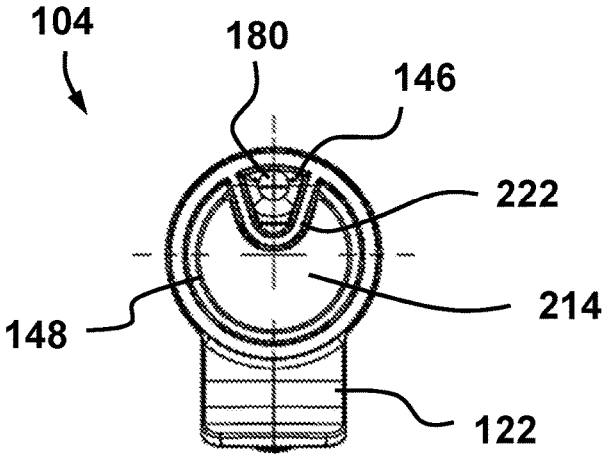
FIG. 21 is a front end view of the first member in FIG. 1.

FIG. 21 is a front end view of the first member 104 in FIG. 1. The front tapered section 156 can be seen at the far end of the liquid duct 148. Likewise, the constricted opening 180 can be seen at the far end of the air duct 146. FIG. 21 further shows that the air duct 146 is separated from the liquid duct 148 inside the first member 104 by a substantially V-shaped sidewall 222. Other shapes, configurations and arrangements are possible.

When the first member 104 is manufactured using an injection molding process of a plastic resin material, a pin is provided within the mold to form the sidewall 222 and the rear end of the air duct 146. This pin, however, is generally too small having for internal liquid channels in which a cooling liquid flows during molding. The slender pin, instead, uses one or more internal gas channels in which a pressurized gas, such as air, can continuously flow. It is also supported at both ends to obtain the desired tolerances. It is supported at the rear through the constricted opening 180. Pressurized air can enter at the front end of the pin and be vented out of the mold through rear venting channels. Cooling the pin can significantly decrease the molding cycle time, among other things. Other configurations and arrangements are also possible.

Figure 22:
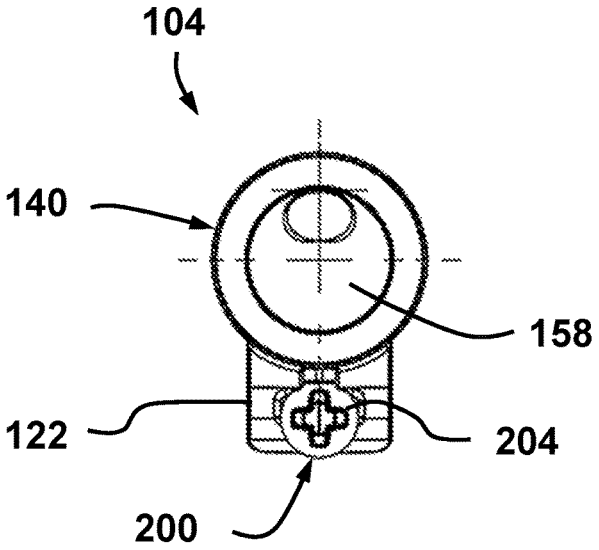
FIG. 22 is a rear end view of the first member in FIG. 1.

FIG. 22 is a rear end view of the first member 104 in FIG. 1. It shows, among other things, the rear-facing open cavity 158 of the valve 140, the mounting member 204 of the second bottom protrusion 200 and the rear side of the first bottom protrusion 120.

Figure 23:
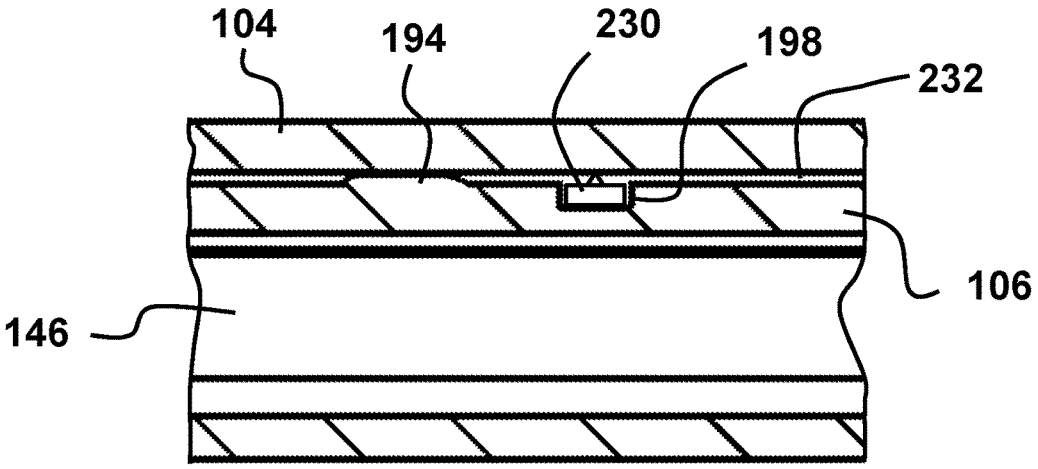
FIG. 23 is an enlarged cross section view of the area surrounding a rear annular groove of the spout in FIG. 1.

FIG. 23 is an enlarged cross section view of the area surrounding the groove 198 of the spout 100 in FIG. 1.

Among other things, it shows semi-schematically the inner gasket 230 being positioned therein. The inner gasket 230 is made of a resilient material and is generally annular in shape. It includes a radially-projecting outer flange around the circumference thereof. This inner gasket 230 is configured and disposed to seal the intervening air gap 232 between the first member 104 and the second member 106. This gap 232 is the intervening space maintained by the guiding elements 192, 194, 196 on the first main body 134, thus including the annular guiding element 194 shown in FIG. 23. The inner gasket 230 prevents air from passing inside the gap 232, more particularly from entering the container 102 during a gravity transfer of the liquid when the valve 140 is opened. The gap 232 is opened at the front end of the second member 106. While the two annular guiding elements 192, 194 block the gap 232 to a certain extent, they do not provide an air-tight seal because of the minimum clearing space required for sliding the two members 104, 106 relative to one another.

Figure 24:
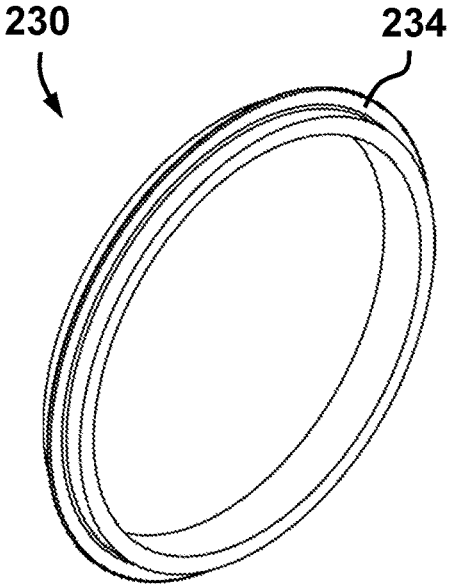
FIG. 24 is an isometric view of the inner gasket that is shown semi-schematically in FIG. 23.
Figure 25:
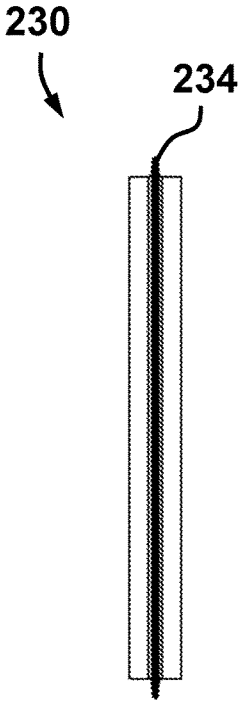
FIG. 25 is a lateral view of the inner gasket that is shown semi-schematically in FIG. 23.
Figure 26:
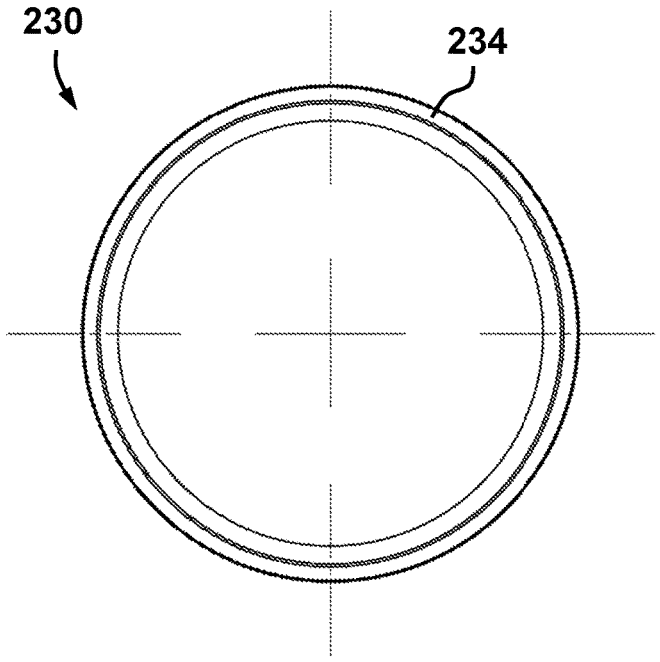
FIG. 26 is a front side view of the inner gasket that is shown semi-schematically in FIG. 23.
Figure 27:
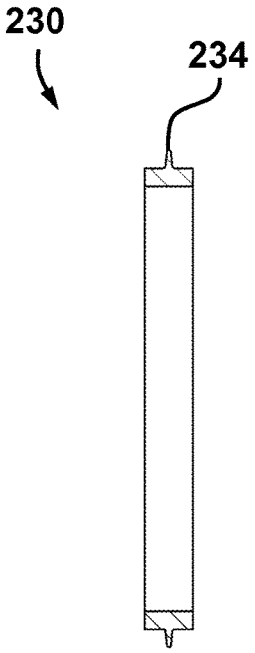
FIG. 27 is a longitudinal cross section view of the inner gasket shown semi-schematically in FIG. 23.

FIGS. 24 to 26 are, respectively, an isometric view, a lateral view and a front side view of the inner gasket 230 that is shown semi-schematically in FIG. 23. FIG. 27 is a longitudinal cross section view of the inner gasket 230. As can be seen, the body of the inner gasket 230 has a substantially T-shaped cross section. It includes a projecting part 234 extending radially outwards to engage the interior of the inner conduit 152. Other shapes, configurations and arrangements are possible. This inner gasket 230 can also be omitted in some implementations.

In use, once the container 102 is tilted, or even set up-side down, to pour liquid through the spout 100, the user will open the valve 140 for the liquid to flow by gravity and will maintain it open, for instance until the receptacle is full or when a sufficient amount of liquid was transferred. The user can control and adjust the flow when pouring by actuating the position of the trigger 122 to set the position of the valve 140. The user may, for instance, progressively reduce the flow of liquid when the receptacle is almost full. This is often desirable to prevent spillage. However, it is sometimes difficult to see when the receptacle is full or almost full. Different factors can be involved, such as an insufficient illumination, the opening of the receptacle being hidden by the container 102, by the spout 100 or by other objects, etc. These factors may force the user to pour the liquid at a slower rate or to interrupt the flow frequently to check the level, thereby increasing the time and effort required for completing the transfer and increasing the likelihood of experiencing an undesirable spillage. Still, the user may be distracted for some reason and not realize that the receptacle is now almost full, or may have overestimated the amount of liquid to be added. This also increases the likelihood of experiencing an undesirable spillage. The illustrated spout 100 can mitigate these difficulties.

As aforesaid, some air must enter the container 102 through the air duct 146 during pouring to replace the proportional volume of liquid flowing out of the liquid duct 148. Air will stop entering the container 102 when the flow of liquid stops. However, interrupting the incoming air flow can also cut off the liquid flow shortly thereafter because of the increased negative pressure, relative to the ambient air pressure, above the liquid level inside the container 102. This negative pressure is what causes the air to enter but if no more air is admitted, the increased negative pressure will decrease the flow and eventually stop it.

Now, since the tip 112 of the illustrated spout 100 is where both the liquid outlet and the air inlet are located, the flow of liquid through the spout 100 will automatically decrease and then stop soon after air is prevented from entering the air duct 146. This highly desirable and convenient feature is only possible because of the air-tight seal provided between the first and second members 104, 106. Furthermore, the fact that the valve 140 is located at the base 110 of the spout 100 allow the user to close the valve 140 after the flow stopped by itself and then move the tip 112 upwards without experiencing any spillage, even if the liquid level in the receptacle was at the very maximum limit, since the spout 100 has no residual liquid therein once closed.

Figure 28:
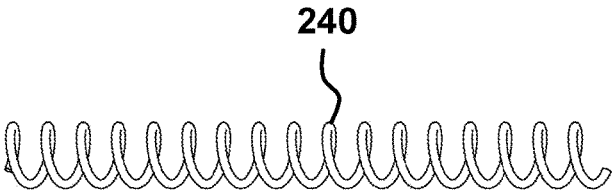
FIG. 28 is a side view showing an example of the spring used as the biasing element in the spout of FIG. 1.

In the illustrated example, the biasing element is a single helical compression spring 240 positioned inside the external conduit 124. FIG. 28 is a side view showing an example of the spring 240. The spring 240 can also be seen in FIGS. 7 and 8. The front end of the spring 240 engages the mounting member 204 while the rear end rests at the bottom end of the external conduit 124. The spring 240 is designed to generate a return force sufficient to overcome the friction between the corresponding parts and to keep the valve 140 suitably sealed in its closed position. However, it is also not too strong to impair handling by the targeted users. The spring 240 can be made of metal. More than one spring 240 can be used in some implementations. Other materials, configurations and arrangements are also possible.

Figure 29:
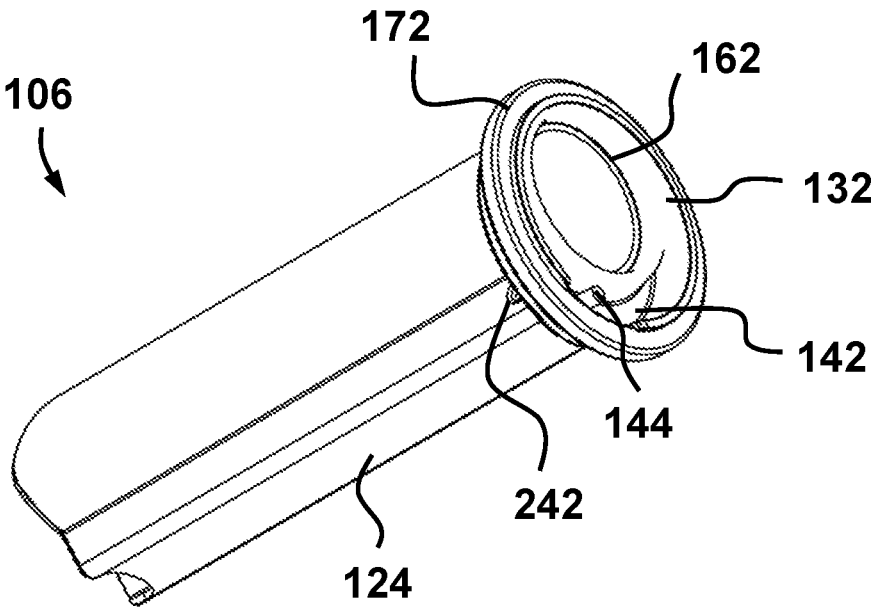
FIG. 29 is an isometric bottom view of the second member in FIG. 1.

FIG. 29 is an isometric bottom view of the second member 106 in FIG. 1. FIG. 29 shows, among other things, that the external conduit 124 located underneath the second main body 150 is opened at the front end thereof.

All parts of the second member 106 can be molded together using an injection molding process and form a monolithic unitary piece. The illustrated second member 106 is an example of an implementation that can be made using an injection molding process of a plastic resin material. It includes a lateral opening 242 on each side of the external conduit 124, near the rear end thereof, which can be useful when retrieving the second member 106 out of its mold. This feature can be omitted in some implementations.

Figure 30:
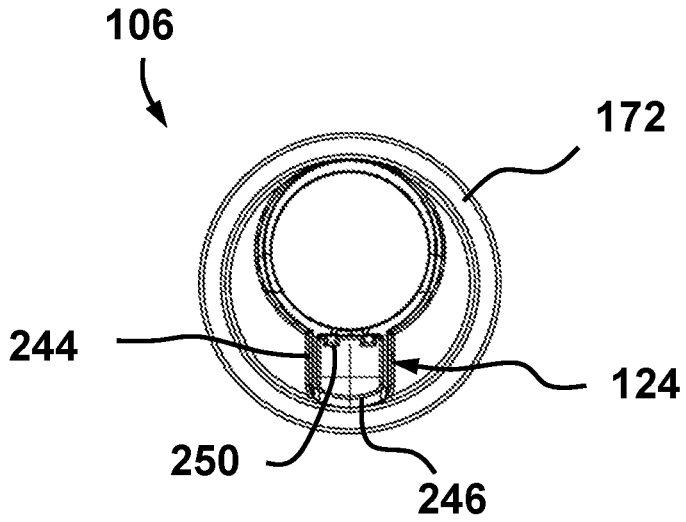
FIG. 30 is a front view of the second member in FIG. 1.

FIG. 30 is a front view of the second member 106 in FIG. 1. Among other things, FIG. 30 shows that the external conduit 124 in the illustrated example has a generally square-shaped cross section defined by two longitudinally-disposed lateral walls 244 and a longitudinally-disposed bottom wall 246. The bottom wall 246 is slightly convex on the outside in the illustrated example. Variants are possible as well.

Still, FIG. 30 shows that the second member 106 includes two spaced-apart ribs 250 on the top side of the external conduit 124. These ribs 250 will cooperate with the CRC device 130 to release it from its unlocked position. These ribs 250 form a disengaging element. Further details will follow.

Figure 31:
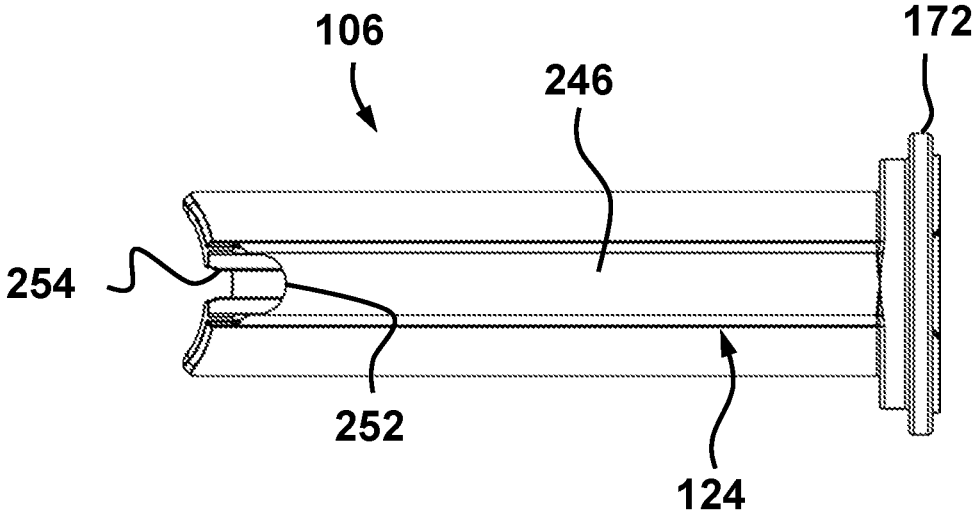
FIG. 31 is a bottom view of the second member in FIG. 1.

FIG. 31 is a bottom view of the second member 106 in FIG. 1. It shows that the bottom wall 246 of the external conduit 124 in the illustrated example includes a curved cut-out portion 252 at the front end. Variants are possible.

FIG. 31 also shows the longitudinally-disposed slot 254 extending within the second member 106 between the top side of the external conduit 124 and the bottom side of the second main body 150. The slot 254 is opened at the front end of the second member 106, as shown. The two ribs 250 seen in FIG. 30 are provided on respective side edges of the slot 254. They are not visible in FIG. 31 because they are hidden within the external conduit 124.

Figure 32:
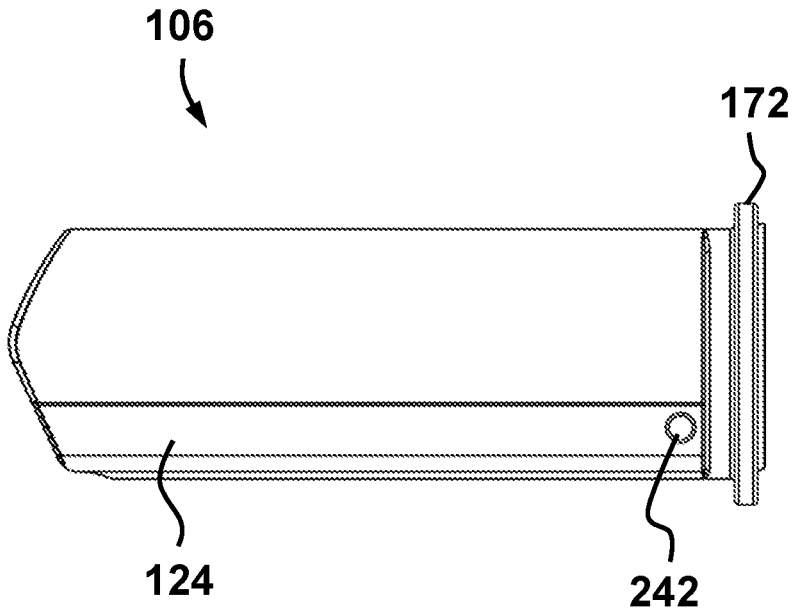
FIG. 32 is a side view of the second member in FIG. 1.

FIG. 32 is a side view of the second member 106 in FIG. 1.

Figure 33:
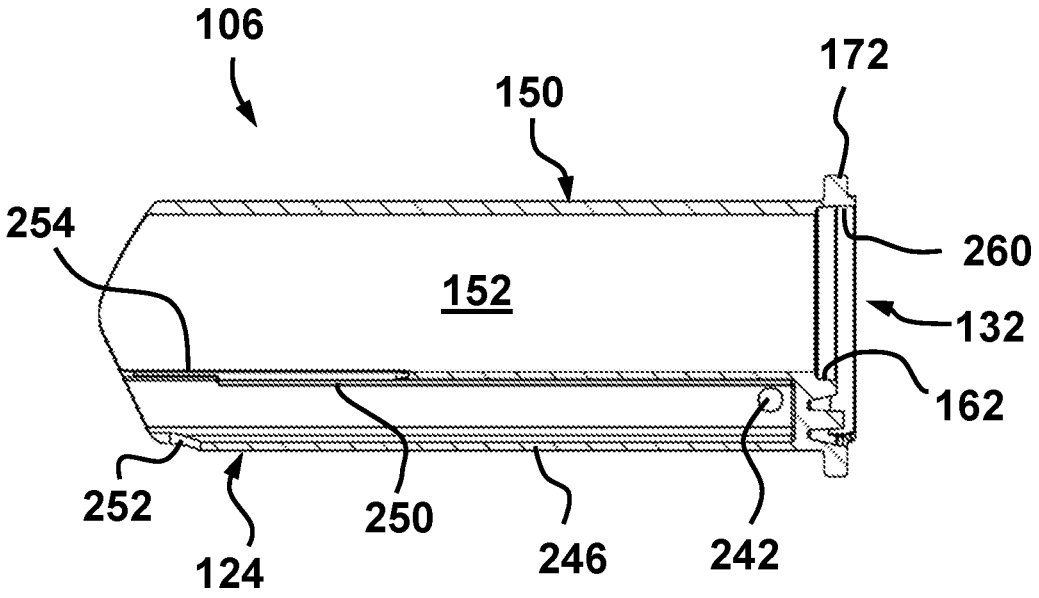
FIG. 33 is a longitudinal cross section view of the second member in FIG. 29.

FIG. 33 is a longitudinal cross section view of the second member 106 in FIG. 1. FIG. 33 shows that in the illustrated example, the valve seat 162, at the top section thereof, merges with the upper wall section 260 of the inner wall surrounding the opening 132 of the base 110. Other configurations and arrangements are possible. This feature can be omitted in some implementations.

Figure 34:
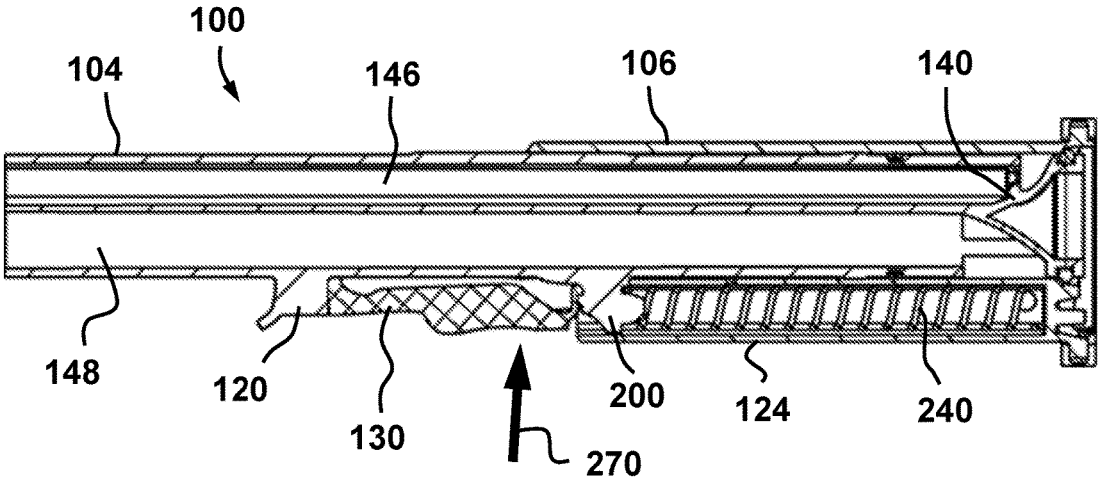
FIG. 34 corresponds to the view in FIG. 7 when the CRC device in FIG. 1 is set in its unlocked position.
Figure 35:
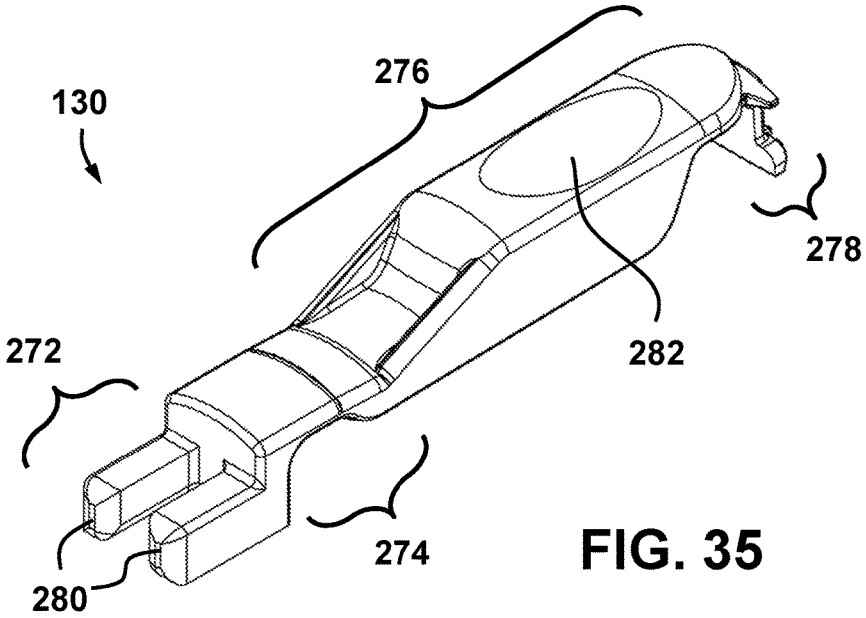
FIG. 35 is an isometric view of the CRC device of the spout in FIG. 1.
Figure 36:
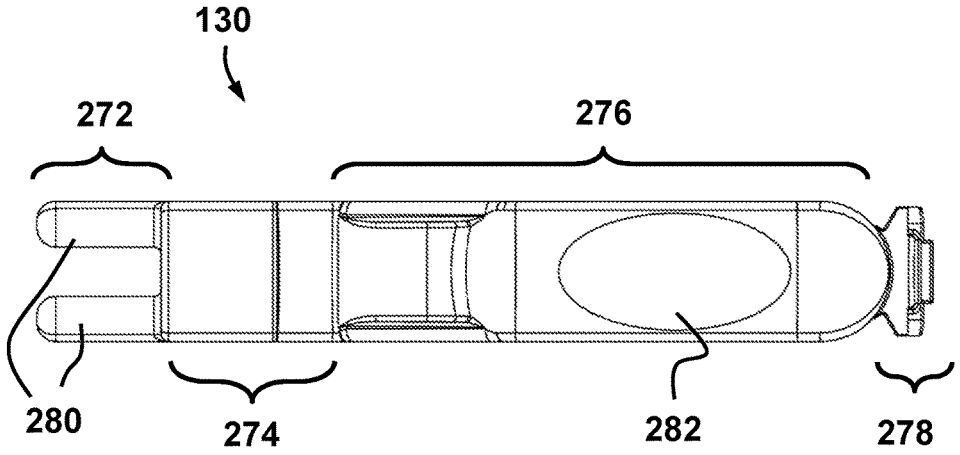
FIG. 36 is a top view of the CRC device as shown in FIG. 35.
Figure 37:
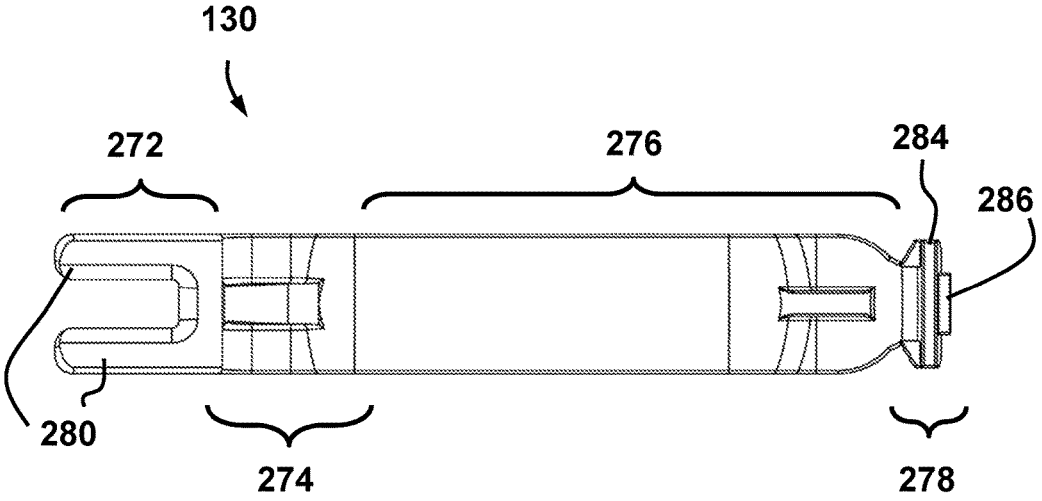
FIG. 37 is a bottom view of the CRC device as shown in FIG. 35.
Figure 38:
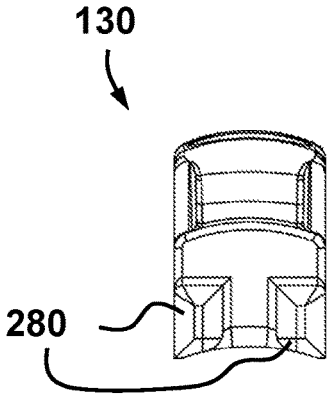
FIG. 38 is a front end view of the CRC device as shown in FIG. 35.
Figure 39:
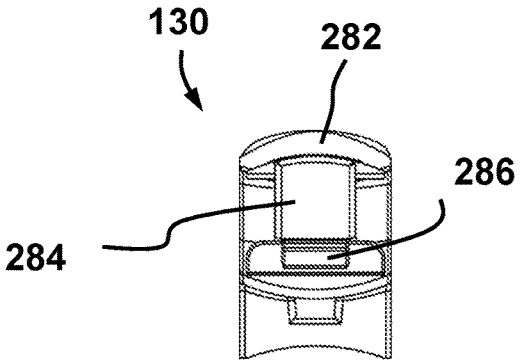
FIG. 39 is a rear end view of the CRC device as shown in FIG. 35.

FIG. 34 corresponds to the view of FIG. 7 when the CRC device 130 in FIG. 1 is set in its unlocked position. A force 270 was applied near the rear end of the CRC device 130 by the user to unlock it. The valve 140 is now ready to be opened. The CRC device 130 will stay unlocked for as long as the valve 140 is not opened enough for some liquid to flow. The force 270 can be applied by a user with one or more fingers. However, the force 270 required to unlock the CRC device 130 is designed to be beyond the physical capabilities of children up to six years old. Variants are possible.

The CRC device 130 in FIG. 1 is illustrated in FIGS. 35 to 39. FIGS. 35 to 39 are, respectively, an isometric view, a top view, a bottom view, a front end view and a rear end view thereof. Other configurations and arrangements are possible as well.

The CRC device 130 of the illustrated example generally includes a front end section 272, a first intermediary section 274, a second intermediary section 276 and a rear end section 278. All sections can be molded together to form a monolithic unitary part. Other configurations and arrangements are possible.

The front end section 272 includes two spaced-apart members 280 that are configured and disposed to fit over the rear supporting element 214 of the first bottom protrusion 120 in a retaining engagement, where they are prevented from moving and pivoting. They allow the CRC device 130 to be set in a cantilevered manner. The exact configuration and arrangement may be different in some implementations.

The first intermediary section 274 is a relatively thinner part compared to the others. It allows the CRC device 130 to bend slightly so that the second intermediary section 276 and the rear end section 278 can be displaced relative to the front end section 272. The first intermediary section 274 acts as a spring. It is made of a highly resistant material, such as a plastic material. Other materials, configurations and arrangements can be used as well.

The second intermediary section 276 is larger in size that the others. It includes a slightly-concave surface 282 at the location where a user must apply the force 270 to set the CRC device 130 to the unlocked position, thus to enable the possibility of moving the valve 140. It is also the part that prevents the valve 140 from being opened when it is in the locked position, for instance as shown in FIG. 7.

The rear end section 278 includes a flanged-like element 284 that is attached at one end to the second intermediary section 276. The other end of the flanged-like element 284 is a free end. The rear end section 278 further includes a small projecting portion 286 that is configured and disposed to latch with the front notch 220 (FIG. 20) on the second bottom protrusion 200 when the force 270 is applied on the surface 282 of the CRC device 130, as shown in FIG. 34. The latching is, on purpose, not easy to achieve because of the resistance created by the relative rigidity of the CRC device 130 at its rear free end. In the illustrated example, the flange-like element 284 must bow slightly towards the front to move upwards as it contacts a front curved surface 224 under the second bottom protrusion 200 (FIG. 20). The force 270 required for this movement is designed to be beyond the capacity of young children, in particular children up to six years old. Variants of this arrangements are possible. Other configurations and arrangements for the childproof locking mechanism are also possible as well.

Figure 40:
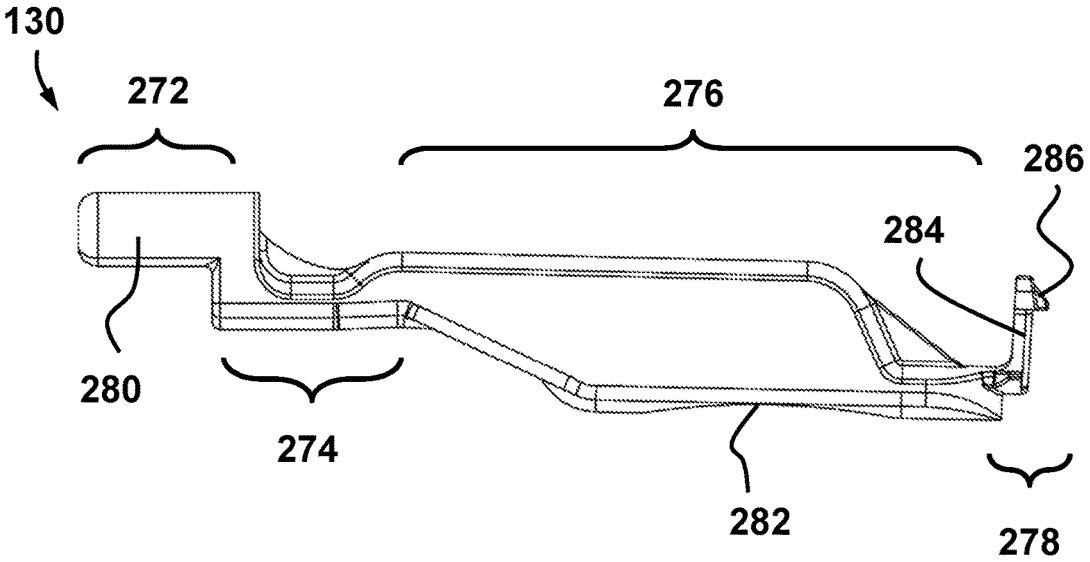
FIG. 40 is a side view of the CRC device positioned as in FIG. 1.

FIG. 40 is a side view of the CRC device 130 but positioned as in FIG. 1. It is thus illustrated with the surface 282 facing downwards to match the position the CRC device 130 has, for instance, in FIG. 1. FIG. 40 also shows the orientation of the projecting portion 286 for selectively latching with the front notch 220.

Figure 41:
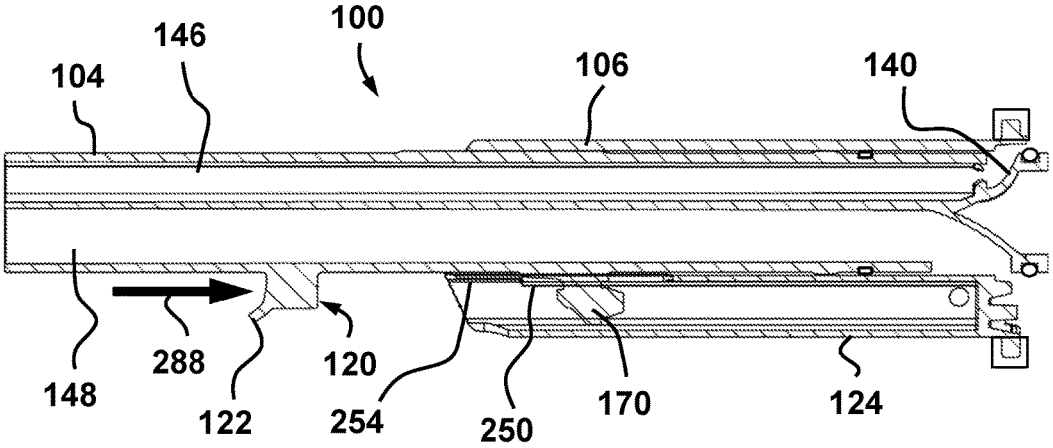
FIG. 41 is a longitudinal cross section view similar to FIG. 34 but with the valve being partially opened.

FIG. 41 is a longitudinal cross section view similar to FIG. 34 but with the valve partially opened. Some of the components, such as the CRC device 130 and the spring 240, were removed for the sake of clarity. FIG. 41 shows an example of the position of the second bottom protrusion 200 when the valve 140 is open due to an actuation force 288 applied by the user on the trigger 122 using, for instance, one or more fingers. The valve 140 is only partially opened in FIG. 41 and the second bottom protrusion 200 can slide further backwards along the slot 254 until the valve 140 reaches its fully-opened position. The second bottom protrusion 200 thus also serve as a guiding element to keep the sliding movement linear along the longitudinal axis 114. Other configurations and arrangements are possible.

At the position shown in FIG. 41, the front side of the second protrusion 200 in the illustrated example is already beyond the front end of the two ribs 250 along the slot 254. The free end of the flanged-like element 284 on the CRC device 130 will have engage the front end of these ribs 250 at that point, thereby causing it to bend slightly towards the front so as to compensate for the presence of the ribs 250. This is enough to force the projecting portion 286 out of its latching engagement with the front notch 220 of the second bottom protrusion 200. The spring-like force generated by the first intermediary section 274 will simultaneously move the second intermediary section 276 and the rear end section 278 downwards until the rear bottom side of the second intermediary section 276 contacts the bottom wall 246 of the external conduit 124. The parts of the CRC device 130 are configured and disposed so that the latching engagement cannot occur again by itself after being disengaged but the actuation of the valve 140 by the user can still continue for as long as it is required. Pressing on the CRC device 130 will also not put it back to its unlocked position when the flanged-like element 284 of the CRC device 130 is still over the ribs 250. Variants of this configuration are possible. For instance, using only one disengaging element, for instance only one rib 250, or using a different disengaging element can be implemented. Other configurations and arrangements are possible as well.

Upon releasing the actuation force of the trigger 122, the spring 240 urges the valve 140 back to its normally-closed position and the CRC device 130 will then come out of the external conduit 124. The second intermediary section 276 will be pushed out in front of the cut-out portion 252 and its rear side will abut against the front edge of the cut-out portion 252 exactly at the position where the valve 140 is fully closed. The rear end section 278 also remains hidden inside the external conduit 124. The valve 140 is blocked in its closed position for as long as the user does not press again on the second intermediary section 276 of the CRC device 130 at unlock it once again.

It should be noted that in use, the weight of the container 102 can be supported on the receptacle, for instance by engaging the trigger 122 over the rim of the opening of the receptacle. The weight of the container 102 will compensate, at least partially, the force required to keep the valve 140 opened while pouring. Furthermore, this can be done without touching the CRC device 130 after the spout 100 was unlocked since the actuation force is applied on the trigger 122. This mitigates the risks of inadvertently damaging the CRC device 130. The trigger 122 as configured and disposed in the illustrated example greatly facilitates handling since the container 102 can be held using only one hand. The same hand can be used to unlock the CRC device 130 and to control the position of the valve 140. The user can take the other hand to hold the recipient or for gripping a fixed object while pouring.

Figure 42:
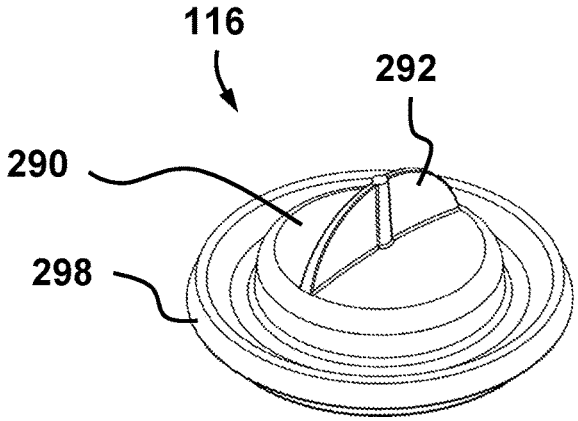
FIG. 42 is an isometric view of the cap in FIGS. 6A and 6B.
Figure 43:
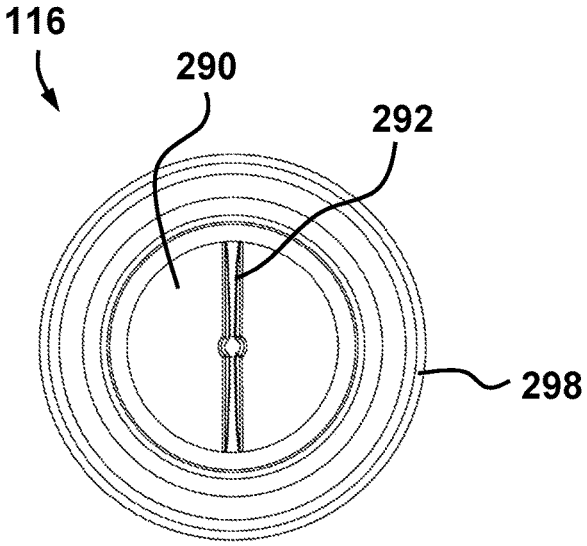
FIG. 43 is a top view of the cap in FIGS. 6A and 6B.
Figure 44:
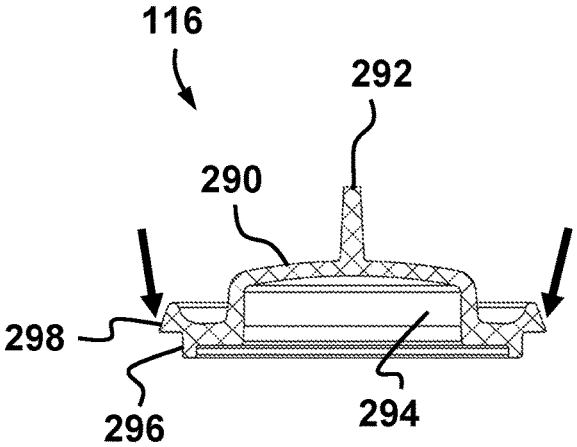
FIG. 44 is a cross section view of the cap in FIGS. 6A and 6B.

FIG. 42 is an isometric view of the cap 116 in FIGS. 6A and 6B. FIG. 43 is a top view thereof. FIG. 44 is a cross section view thereof.

As can be seen, the cap 116 of the illustrated example includes a main body 290 having a central section over which a knob 292 is provided. The central section of the main body 290 defines a cavity 294 opened on the bottom side. This bottom cavity 294 is configured and shaped to receive the tip 112 of the spout 100, as shown for instance in FIG. 6A. The main body 290 of the cap 116 in the illustrated example further includes a bottom annular portion 296. The outer diameter of this bottom annular portion 296 is configured and shaped to fit inside the opening 132 of the base 110 and will allow the cap 116 to hold as previously described. An upper annular portion 298 is present immediately above the bottom annular portion 296 and has a larger outer diameter. The underside of this upper annular portion 298 will engage the rear annular side face around the base 110. As can be seen, the outer face of the upper annular portion 298 is set at an angle with reference to the vertical axis in FIG. 45. This corresponds to the position of the edge surrounding the central opening of the rim cap and is schematically illustrated in FIG. 45 by the arrows. Therefore, when the spout 100 is inside the container 102 and the cap 116 closes the opening of the base 110, the rim cap will press on the periphery of the cap 116 when it is tightened, thereby securing the cap 116 in place.

As can be appreciated, the spout 100 as proposed herein can have, among other things, one or more the following advantages:

- the liquid output is maximized because of the smaller flow restrictions;
- the initial response time is very fast, and the liquid can start flowing fast almost immediately after opening the valve 140;
- the flow is constant when pouring;
- the valve 140 is normally closed;
- the flow will automatically be decreased and then stopped when the spout tip 112 is immerged;
- the CRC device 130 prevents a young child from accidently opening it and spilling the liquid that is inside the container 102;
- the CRC device 130 can be designed, as shown, to operate without any additional external spring;
- the surfaces exposed to the liquid are minimized since no liquid can enter the air duct 146;
- the valve 140 is at the base 110 of the spout 100 and cannot accumulate therein;
- the spout 100 can be stored outside or inside the container 102;
- the spout 100 can be operated using a single hand;
- the weight of the container 102 can be supported on the receptacle and this can also help controlling the position of the valve 140;
- the actuation force to control the position of the valve 140 is not applied directly on the CRC device 130;
- the number of plastic parts is minimal, for instance being only three in the illustrated example, plus the cap 116, the spring 240 and the three gaskets 130, 160, 230;
- the same cap 116 can be used at two different locations on the spout 100.

The present detailed description and the appended figures are meant to be exemplary only, and a skilled person will recognize that variants can be made in light of a review of the present disclosure without departing from the proposed concept.

LIST OF REFERENCE NUMERALS

100 spout
102 liquid-storage container
104 first member
106 second member
110 base (of the spout)
112 tip (of the spout)
114 longitudinal axis
116 cap
120 first bottom protrusion
122 trigger
124 external conduit
130 child resistant closure (CRC) device
132 opening (of the spout base)
134 first main body (of the first member)
136 front section (of the first main body)
138 rear section (of the first main body)
140 valve
142 recess
144 peg
146 air duct
148 liquid duct
150 second main body (of the second member)
152 inner conduit (of the second main body)
154 rear section (of the valve)
156 front tapered section (of the valve)
158 rear-facing open cavity (of the valve)
160 valve gasket (O-ring)
162 valve seat
164 mounting groove (for valve gasket)
170 outer gasket (U-ring)
172 outer peripheral flange
180 constricted opening
182 plenum
184 slanted and/or curved top surface
192 annular guiding element
194 annular guiding element
196 longitudinally-extending guiding element
198 groove (for the inner gasket)
200 second bottom protrusion
202 base portion (of the second bottom protrusion)
204 mounting member
210 opening (adjacent the valve)
212 supporting member
214 rear supporting element (of the first bottom protrusion)
220 front notch
222 V-shaped sidewall
224 front curved surface (under the second bottom protrusion)
230 inner gasket (T-ring)
232 gap
234 projecting part (on the inner gasket)
240 biasing element/spring
242 lateral opening

244 longitudinally-extending lateral wall
246 bottom wall
250 rib
252 cut-out portion
254 slot
260 upper wall section
270 force (to unlock)
272 front end section (of latch member)
274 first intermediary section (of latch member)
276 second intermediary section (of latch member)
278 rear end section (of latch member)
280 spaced-apart member
282 concave surface
284 flanged-like element
286 projecting portion
288 actuation force
290 main body (of the cap)
292 knob (of the cap)
294 cavity (of the cap)
296 bottom annular portion (of the cap)
298 upper annular portion (of the cap)

The invention claimed is:

1. A vented pouring spout for a liquid-storage container, the spout including:

a first member including:

an elongated and generally tubular first main body having a front section and a rear section, the first main body having two segregated and parallel internal passageways, one being an air duct through which an air circuit passes when air enters the container and one being a liquid duct through which a liquid circuit passes when the liquid flows out of the container, the air duct being generally positioned along a top side of the first main body and being smaller in cross section than that of the liquid duct, the liquid duct being substantially straight and substantially unobstructed along the entire first main body, the air duct being substantially straight and substantially unobstructed along the entire first main body up to at least one constricted opening, generally positioned at a rear end of the first main body, from which the air circuit exits the air duct;

a valve that is juxtaposed to the rear end of the first main body, the valve having a rear section and a front tapered section extending from the rear section, the rear section of the valve supporting a valve gasket and the front tapered section being made integral with the rear section of the first main body, the front tapered section being adjacent to an inlet of the liquid duct and to the at least one constricted opening; and a first bottom protrusion projecting underneath the front section of the first main body;

a second member that is shorter in length than the first member, the second member including an elongated second main body, the second main body having a straight tubular inner conduit inside which the rear section of the first main body is slidingly axially movable, the inner conduit having a rear end defining a valve seat that is engaged by the valve gasket when the valve is in a closed position to block the air circuit and the liquid circuit, the valve gasket being out of engagement with the valve seat and being positioned rearward of the valve seat when the valve is in a fully-opened position;

an inner gasket provided between the first member and the second member to seal in an air-tight manner an intervening peripheral space between the rear section of the first main body and the inner conduit of the second main body; and a biasing element positioned between the first member and the second member to urge the valve in the closed position.

2. The spout as defined in claim 1, wherein the spout includes a child resistant closure (CRC) device mounted between the first member and the second member, the CRC device having a locked position where the valve is prevented from moving out of the closed position, and an unlocked position where the valve the first member can be slid rearward with reference to the second member to open the valve.

3. The spout as defined in claim 2, wherein the CRC device selectively latches with a front notch provided on a second bottom protrusion projecting underneath the rear section of the first main body to put the CRC device in the unlock position, the second bottom protrusion being axially movable with reference to the second member along a corresponding longitudinally-disposed slot made along the inner conduit.

4. The spout as defined in claim 3, wherein the CRC device has a front end affixed to the first bottom protrusion and rear free end that includes a flanged-like element, the flanged-like element having a projecting portion that is configured and disposed to latch with the front notch on the second bottom protrusion when an upward force is applied on the CRC device.

5. The spout as defined in claim 4, wherein the CRC device is configured to require the upward force to be beyond what children up to six years old can apply.

6. The spout as defined in claim 4, wherein the CRC device is unlatched from the front notch once the valve once the flanged-like element engages a disengaging element.

7. The spout as defined in claim 6, wherein the disengaging element includes a pair of spaced-apart ribs provided along respective sides of the slot.

8. The spout as defined in claim 2, wherein the CRC device is affixed to a rear side of the first bottom protrusion in a cantilevered manner, the CRC device, when in its locked position, engaging a part of the second member to prevent the first and second members from axially moving with reference from one another so as to open the valve.

9. The spout as defined in claim 8, wherein the second member includes an elongated external conduit longitudinally extending underneath the second main body, the external conduit receiving the biasing element, the external conduit having an opened front end with a cut-out portion engaging a rear side of the CRC device in its locked position.

10. The spout as defined in claim 1, wherein the biasing element includes a compression helical spring.

11. The spout as defined in claim 1, wherein the inner gasket is mounted in an outer annular groove on the rear section of the first main body.

12. The spout as defined in claim 11, wherein the inner gasket has an inverted T-shaped cross section.

13. The spout as defined in claim 1, wherein the spout includes at least one of the following two features:

the rear section of the first main body includes two-spaced apart annular guiding elements;

the constricted opening has a minimal cross section area that is from 40% to 70% smaller than that of the air duct.

14. The spout as defined in claim 13, wherein the first main body further includes a longitudinally-disposed guiding element extending from a foremost among the two annular guiding elements.

15. The spout as defined in claim 1, wherein the spout includes at least one of the following two features:

first bottom protrusion includes a front-facing trigger;

the second member includes an enlarged end portion forming a base of the spout, the enlarged end portion having a radially-extending flange made integral with the rear end of the second main body and receiving an outer gasket.

16. The spout as defined in claim 1, further including a protective cap, the cap having a main body with a bottom cavity configured and shaped to receive a tip of the spout in an interfering engagement.

17. The spout as defined in claim 16, wherein the main body of the protective cap includes a bottom annular portion configured and shaped to fit inside the opening of the base in an interfering engagement.

18. The spout as defined in claim 1, wherein the front tapered section of the valve includes a top surface positioned immediately adjacent to but spaced apart from the constricted opening.

19. The spout as defined in claim 18, wherein the top surface is slanted, curved or both.

20. The spout as defined in claim 19, wherein the top surface has a mirror-like surface finish.

* * * * *